US011034155B2

(12) United States Patent
Sato et al.

(10) Patent No.: US 11,034,155 B2
(45) Date of Patent: Jun. 15, 2021

(54) LIQUID RESERVOIR UNIT, LIQUID EJECTING APPARATUS, AND MAINTENANCE METHOD FOR LIQUID EJECTING APPARATUS

(71) Applicant: SEIKO EPSON CORPORATION, Tokyo (JP)

(72) Inventors: Hisashi Sato, Shiojiri (JP); Kazuyuki Fujioka, Matsumoto (JP); Yuichi Urabe, Shiojiri (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/569,187

(22) Filed: Sep. 12, 2019

(65) Prior Publication Data

US 2020/0079093 A1 Mar. 12, 2020

(30) Foreign Application Priority Data

Sep. 12, 2018 (JP) ..... JP2018-170575
Nov. 15, 2018 (JP) ..... JP2018-214772

(51) Int. Cl.
*B41J 2/175* (2006.01)
*B41J 2/165* (2006.01)

(52) U.S. Cl.
CPC ..... *B41J 2/17506* (2013.01); *B41J 2/16508* (2013.01); *B41J 2/16535* (2013.01); *B41J 2/1753* (2013.01); *B41J 2/16552* (2013.01); *B41J 2/17596* (2013.01)

(58) Field of Classification Search
CPC ..... B41J 2/16508; B41J 2/16523; B41J 2/16532; B41J 2/16535; B41J 2/16552; B41J 2/175; B41J 2/17506; B41J 2/17513; B41J 2002/17516; B41J 2/1752;
(Continued)

(56) References Cited

U.S. PATENT DOCUMENTS 5,721,576 A * 2/1998 Barinaga ..... B41J 2/17506 141/329
6,142,617 A * 11/2000 Barinaga ..... B41J 2/17503 347/85
(Continued)

FOREIGN PATENT DOCUMENTS

JP 2000-263807 9/2000
JP 2003-159809 6/2003
(Continued)

*Primary Examiner* — Anh T Vo
(74) *Attorney, Agent, or Firm* — Workman Nydegger

(57) ABSTRACT

A liquid reservoir unit includes a reservoir portion, an outflow portion disposed at a position near a first end of the reservoir portion, and an inflow portion disposed at a position near the first end of the reservoir portion. The outflow portion includes an outflow opening opened to an interior of the reservoir portion, and the inflow portion includes an inflow opening opened to the interior of the reservoir portion. The outflow opening and the inflow opening are located at different positions in a width direction which is a lengthwise direction of the reservoir portion when the reservoir portion is viewed from the first end, and also located at different positions in a depth direction from the first end toward a second end on the opposite side to the first end.

20 Claims, 14 Drawing Sheets

(58) Field of Classification Search
CPC .. B41J 2/17523; B41J 2/1753; B41J 2/17553; B41J 2/17566; B41J 2/17596; B41J 29/13
See application file for complete search history.

(56) References Cited

U.S. PATENT DOCUMENTS

| | | | | |
|---|---|---|---|---|
| 6,742,882 | B2 * | 6/2004 | Nakamura | B41J 2/175 347/89 |
| 6,959,985 | B2 * | 11/2005 | Steinmetz | B41J 2/1752 347/86 |
| 2002/0113852 | A1 | 8/2002 | Kimura et al. | |
| 2009/0289972 | A1 | 11/2009 | Ilino | |
| 2011/0050766 | A1 | 3/2011 | Matsumoto et al. | |
| 2011/0050793 | A1 | 3/2011 | Kumagai et al. | |
| 2011/0128314 | A1 | 6/2011 | Akatsuka | |
| 2014/0098146 | A1 | 4/2014 | Kamiyama | |
| 2014/0168295 | A1 | 6/2014 | Ichihara et al. | |

FOREIGN PATENT DOCUMENTS

| | | |
|---|---|---|
| JP | 2003-159811 | 6/2003 |
| JP | 2007-105923 | 4/2007 |
| JP | 2008-213281 | 9/2008 |
| JP | 2009-279878 | 12/2009 |
| JP | 2010-131976 | 6/2010 |
| JP | 2011-079187 | 4/2011 |
| JP | 2011-110833 | 6/2011 |
| JP | 2011-235506 | 11/2011 |
| JP | 2013-184428 | 9/2013 |
| JP | 2014-054857 | 3/2014 |
| JP | 2014-076577 | 5/2014 |
| JP | 2014-079973 | 5/2014 |
| JP | 2014-094485 | 5/2014 |
| JP | 2014-117898 | 6/2014 |
| JP | 2014-168961 | 9/2014 |
| JP | 2016-112805 | 6/2016 |
| WO | WO 2008/108245 | 9/2008 |

* cited by examiner

LIQUID RESERVOIR UNIT, LIQUID EJECTING APPARATUS, AND MAINTENANCE METHOD FOR LIQUID EJECTING APPARATUS

The present application is based on, and claims priority from JP Application Serial Number 2018-170575, filed Sep. 12, 2018 and JP Application Serial Number 2018-214772, filed Nov. 15, 2018, the disclosures of which are hereby incorporated by reference herein in their entirety.

BACKGROUND

1. Technical Field

The present disclosure relates to a liquid reservoir unit configured to store a liquid, a liquid ejecting apparatus including a liquid reservoir unit, and a maintenance method for a liquid ejecting apparatus.

2. Related Art

JP-A-2000-263807 discloses, as an example of a liquid ejecting apparatus, an ink jet recording apparatus including a sub-tank which is an example of a liquid reservoir unit. The sub-tank is configured to store ink which is an example of a liquid. The ink jet recording apparatus records an image on a medium by ejecting a liquid stored in the sub-tank.

In the ink jet recording apparatus disclosed in JP-A-2000-263807, components of the liquid may settle in the sub-tank. When the components of the liquid settle, unevenness of the concentration is generated, which affects the recording quality.

SUMMARY

A liquid reservoir unit for solving the above problem includes a reservoir portion configured to store a liquid; an outflow portion disposed at a position near a first end of the reservoir portion and configured to cause the liquid to flow out of the reservoir portion; and an inflow portion disposed at a position near the first end of the reservoir portion and configured to cause the liquid to flow into the reservoir portion. The outflow portion includes an outflow opening opened to an interior of the reservoir portion, and the inflow portion includes an inflow opening opened to the interior of the reservoir portion. The outflow opening and the inflow opening are located at different positions in a width direction which is a lengthwise direction of the reservoir portion when the reservoir portion is viewed from the first end, and also located at different positions in a depth direction from the first end toward a second end on the opposite side to the first end.

A liquid ejecting apparatus for solving the above problem includes a liquid ejecting portion configured to eject a liquid through a nozzle; a liquid supply flow path configured to supply the liquid contained in a liquid supply source to the liquid ejecting portion; a liquid reservoir unit having a reservoir portion that is provided in the liquid supply flow path and is configured to store the liquid; a discharge mechanism configured to discharge the liquid in the liquid supply flow path from a side of the liquid ejecting portion relative to the reservoir portion in the liquid supply flow path by depressurizing the liquid supply flow path; and a control portion configured to control the discharge mechanism to discharge the liquid staying in the reservoir portion as a waste liquid when a stay of the liquid in the reservoir portion exceeds a set time.

A maintenance method for a liquid ejecting apparatus for solving the above problem is a maintenance method for the liquid ejecting apparatus that includes a liquid ejecting portion configured to eject a liquid through a nozzle; a liquid supply flow path configured to supply the liquid contained in a liquid supply source to the liquid ejecting portion; and a liquid reservoir unit having a reservoir portion that is provided in the liquid supply flow path and is configured to store the liquid. The method includes discharging the liquid staying in the reservoir portion as a waste liquid when a stay of the liquid in the reservoir portion exceeds a set time.

A liquid ejecting apparatus for solving the above problem includes a liquid ejecting portion configured to eject a liquid through a nozzle; a holding portion configured to attach and detach a liquid supply source for containing the liquid; a liquid supply flow path configured to supply the liquid from the liquid supply source attached to the holding portion to the liquid ejecting portion; a reservoir portion provided in the liquid supply flow path and configured to store the liquid; a reservoir amount adjustment mechanism configured to adjust a reservoir amount of the liquid stored in the reservoir portion; and a control portion configured to control the reservoir amount adjustment mechanism in such a manner that, when an upper limit value of the reservoir amount is defined as a first upper limit value in a case in which a remaining amount of the liquid contained in the liquid supply source is equal to or smaller than a predetermined value, the reservoir amount when the remaining amount is larger than the predetermined value is caused to be smaller than the first upper limit value.

A control method for a liquid ejecting apparatus for solving the above problem is a control method for the liquid ejecting apparatus that includes a liquid ejecting portion configured to eject a liquid through a nozzle; a liquid supply flow path configured to supply the liquid contained in a liquid supply source to the liquid ejecting portion; and a reservoir portion provided in the liquid supply flow path and configured to store the liquid. The method includes, when an upper limit value of a reservoir amount of the liquid stored in the reservoir portion is defined as a first upper limit value in a case in which a remaining amount of the liquid contained in the liquid supply source is equal to or smaller than a predetermined value, performing adjustment in such a manner that the reservoir amount when the remaining amount is larger than the predetermined value is caused to be smaller than the first upper limit value.

DESCRIPTION OF EXEMPLARY EMBODIMENTS

First Embodiment

Hereinafter, a first embodiment of a liquid ejecting apparatus will be described with reference to the drawings. A liquid ejecting apparatus is, for example, an ink jet printer configured to print an image such as characters or photographs by ejecting ink, which is an example of a liquid, onto a medium such as paper.

Figure 1:
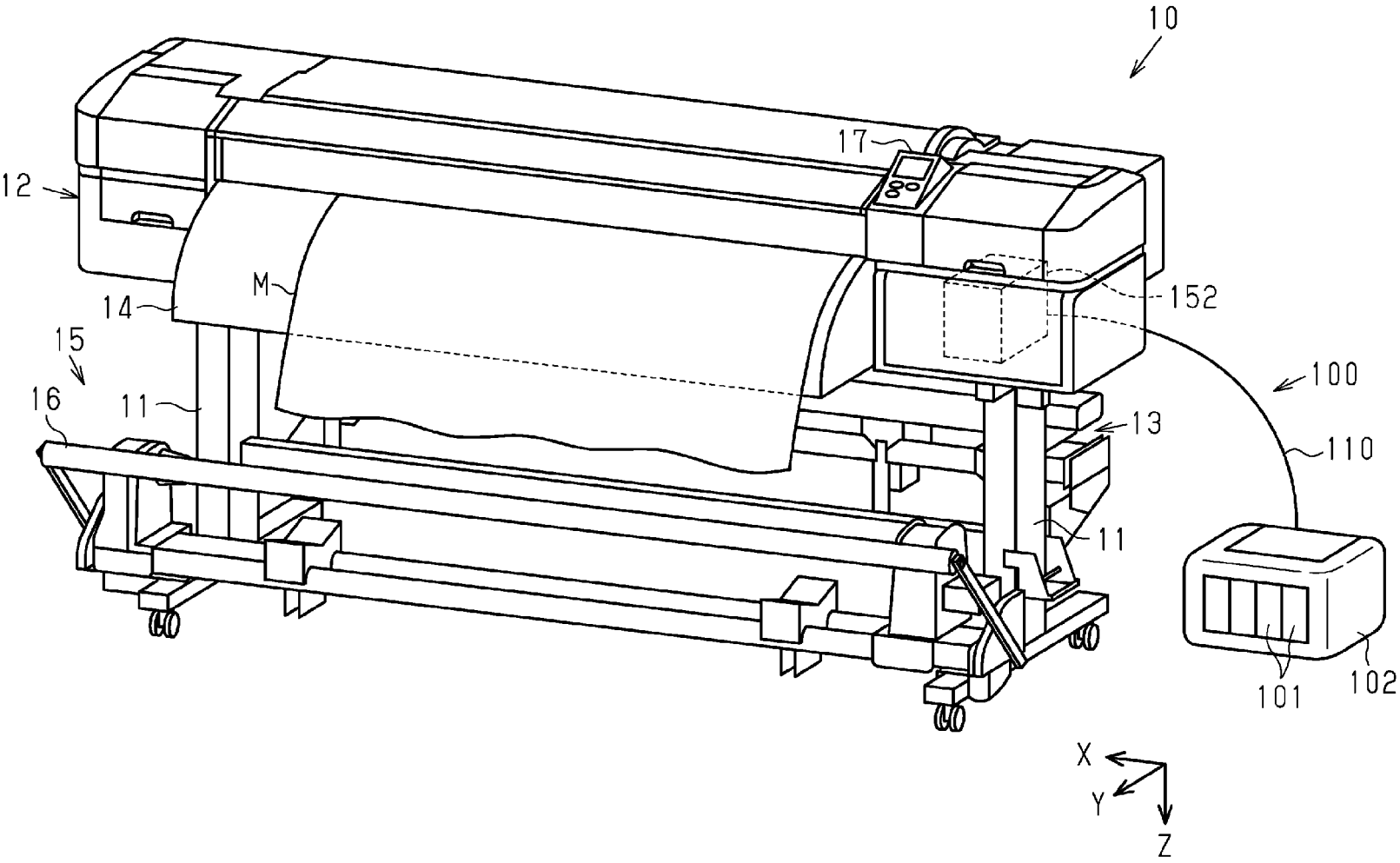
FIG. 1 is a perspective view illustrating a first embodiment of a liquid ejecting apparatus.

As illustrated in FIG. 1, a liquid ejecting apparatus 10 includes a pair of leg portions 11 and a housing 12 mounted on the leg portions 11. The liquid ejecting apparatus 10 is provided with a feeding portion 13 configured to feed out a medium M wound on a roll body into the housing 12, a guide portion 14 configured to guide the medium M discharged from the housing 12, and a winding portion 15 configured to wind the medium M guided by the guide portion 14 on a roll body. The liquid ejecting apparatus 10 includes a tension applying mechanism 16 configured to give tension to the medium M to be wound by the winding portion 15, and an operation panel 17 to be operated by a user.

The liquid ejecting apparatus 10 has predetermined lengths as its width, depth, and height in a state of being installed on a place where it is used. The direction of gravity is indicated by a Z-axis, assuming that the liquid ejecting apparatus 10 is disposed on a horizontal plane. At this time, the width direction and the depth direction of the liquid ejecting apparatus 10 are substantially horizontal. The width direction of the liquid ejecting apparatus 10 is indicated by an X-axis. The X-axis, an Y-axis, and the Z-axis are orthogonal to each other. Therefore, the X-axis, the Y-axis, and the Z-axis are coordinate axes indicating the width, depth, and height of the liquid ejecting apparatus 10, respectively.

Figure 2:
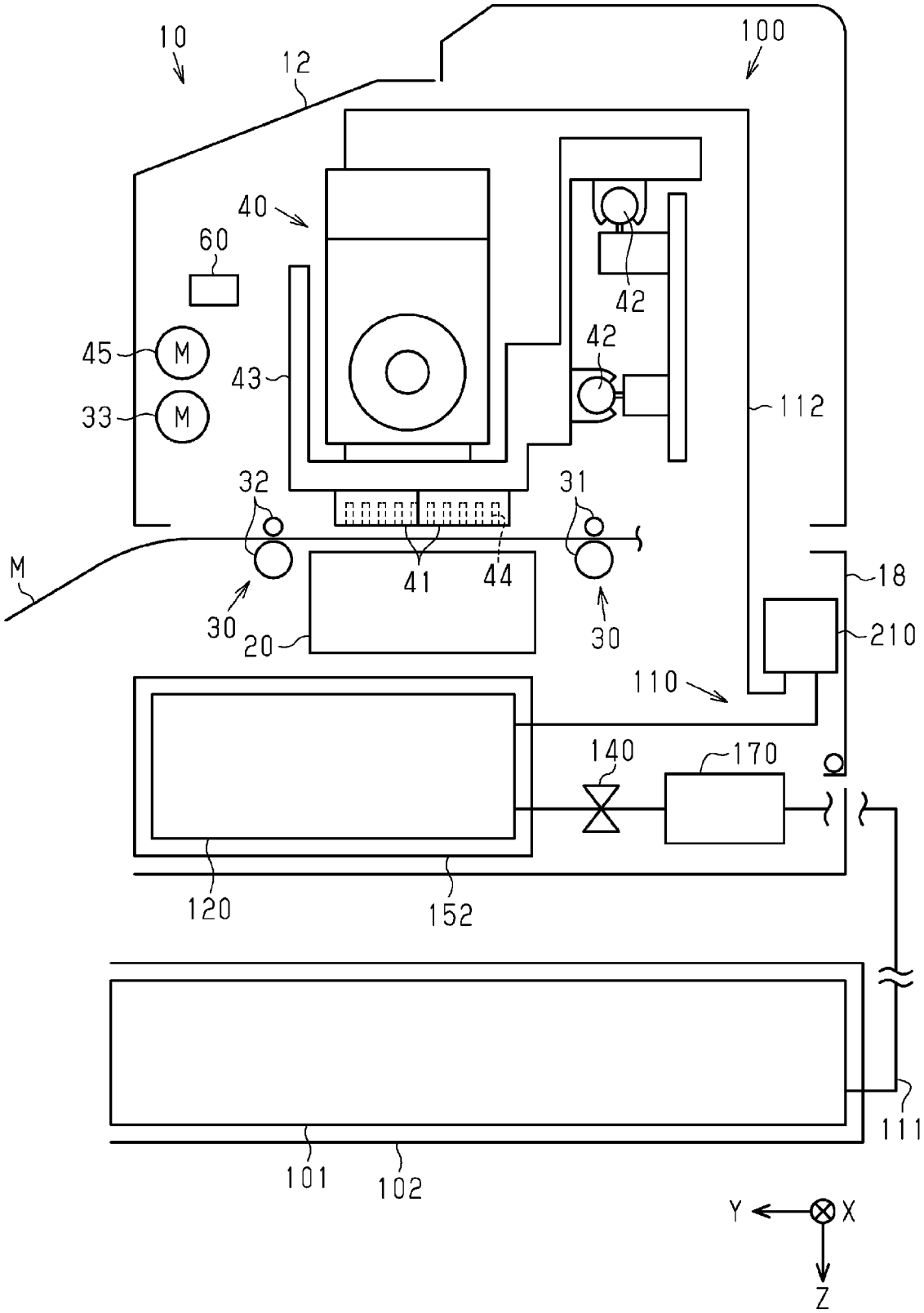
FIG. 2 is a side view schematically illustrating an internal structure of a liquid ejecting apparatus.

As illustrated in FIG. 2, the liquid ejecting apparatus 10 includes a support base 20 for supporting the medium M, and a transportation portion 30 for transporting the medium M. The liquid ejecting apparatus 10 includes a printing portion 40 configured to print on the medium M, and a control portion 60 configured to control operations of the liquid ejecting apparatus 10. The liquid ejecting apparatus 10 is provided with a liquid supply device 100 configured to supply a liquid to the printing portion 40. The control portion 60 is configured to include, for example, a CPU, a memory, and the like. The control portion 60 controls the liquid ejecting apparatus 10 and the liquid supply device 100 by the CPU executing a program stored in the memory.

The support base 20 is so provided as to extend in the width direction of the liquid ejecting apparatus 10. In the present embodiment, the width direction of the liquid ejecting apparatus 10 is coincident with the width direction of the medium M. The medium M is transported in a direction opposite to the depth direction of the liquid ejecting apparatus 10 on the support base 20. Therefore, the transportation direction of the medium M is opposite to the depth direction of the liquid ejecting apparatus 10.

The transportation portion 30 includes a pair of transportation rollers 31 located upstream of the support base 20 in the transportation direction, and a pair of transportation rollers 32 located downstream of the support base 20. The transportation portion 30 is provided with a transportation motor 33 for driving the pair of transportation rollers 31 and the pair of transportation rollers 32. When the pair of transportation rollers 31 and the pair of transportation rollers 32 are driven by the transportation motor 33, the medium M pinched between the pair of transportation rollers 31 and between the pair of transportation rollers 32 is transported in the transportation direction along a surface of the support base 20.

The printing portion 40 includes a liquid ejecting portion 41 configured to eject a liquid through a nozzle 44. The printing portion 40 of the present embodiment includes a guide shaft 42 provided in such a manner as to extend in the width direction, and a carriage 43 configured to reciprocate in the width direction by being guided by the guide shaft 42.

The printing portion 40 is provided with a carriage motor 45 for moving the carriage 43 along the guide shaft 42. The carriage 43 is moved in accordance with the driving of the carriage motor 45. That is, the liquid ejecting apparatus 10 of the present embodiment is a serial type apparatus in which the liquid ejecting portion 41 scans with respect to the medium M. The liquid ejecting apparatus 10 may be configured as a line type apparatus in which the liquid ejecting portion 41 is provided having a long size in the width direction.

Figure 3:
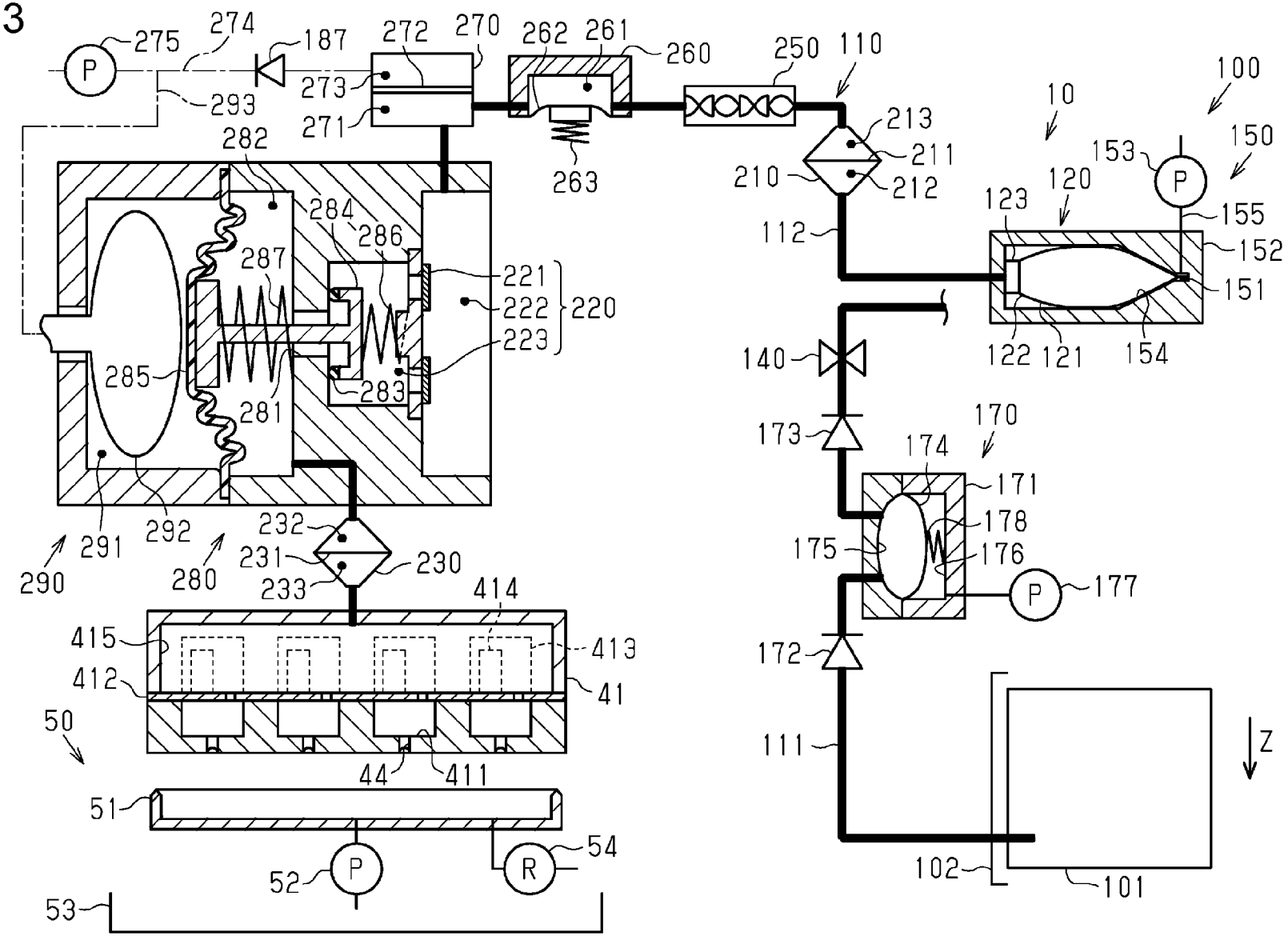
FIG. 3 is a schematic diagram illustrating a configuration of a liquid ejecting apparatus and a liquid supply device.

As illustrated in FIG. 3, the liquid ejecting portion 41 includes one or a plurality of nozzles 44 for ejecting a liquid. The liquid ejecting portion 41 includes an individual liquid chamber 411 communicating with the nozzle 44, an accommodation portion 413 separated by a vibration plate 412 from the individual liquid chamber 411, and an actuator 414 accommodated in the accommodation portion 413. The liquid ejecting portion 41 is provided with a common liquid chamber 415 for temporarily storing the supplied liquid and supplying the liquid to a plurality of individual liquid chambers 411.

The actuator 414 is, for example, a piezoelectric element configured to contract when a drive voltage is applied thereto. After the vibration plate 412 is deformed with the contraction of the actuator 414, when the application of the drive voltage is stopped, the liquid in the individual liquid chamber 411 whose volume has been changed is ejected as a droplet through the nozzle 44.

The liquid ejecting apparatus 10 includes a liquid supply flow path 110 and a liquid reservoir unit 120 as constituent elements of the liquid supply device 100. The liquid supply flow path 110 is configured to supply a liquid contained in a liquid supply source 101 to the liquid ejecting portion 41. The liquid supply flow path 110 couples the liquid ejecting portion 41 to the liquid supply source 101 serving as a liquid supply source to the liquid ejecting portion 41. The liquid supply flow path 110 is configured to include, for example, a tube.

The liquid reservoir unit 120 includes a reservoir portion 121 configured to store a liquid. The liquid reservoir unit 120 is provided in the liquid supply flow path 110. The liquid reservoir unit 120 is located between the liquid supply source 101 and the liquid ejecting portion 41 in the liquid supply flow path 110. The liquid reservoir unit 120 stores a liquid supplied from the liquid supply source 101. Therefore, the liquid reservoir unit 120 is located downstream of the liquid supply source 101 in the direction in which the liquid is supplied.

The reservoir portion 121 may be formed of a bag-like member 122 having flexibility. The liquid reservoir unit 120 of the present embodiment includes the reservoir portion 121 formed of the bag-like member 122, and a connection body 123 configured to be coupled to the liquid supply flow path 110. The liquid supplied from the liquid supply source 101 is stored in the reservoir portion 121 through the connection body 123. Since the reservoir portion 121 is formed of the bag-like member 122, it is inflated or deflated in accordance with the amount of the liquid that is stored. That is, the volume of the reservoir portion 121 changes by being inflated or deflated.

The liquid reservoir unit 120 may be configured to store a predetermined amount or more than a predetermined amount of liquid while the liquid is supplied from the liquid supply source 101. The predetermined amount is an amount which is expected to be used for printing one image. With this, even when the liquid in the liquid supply source 101 is exhausted during the printing of an image, the printing of the image may be continued by using the liquid stored in the liquid reservoir unit 120. This reduces a risk of the interruption of printing. Further, it is possible to suppress deterioration in print quality such as color unevenness due to the interruption of printing.

When a remaining amount of the liquid contained in the liquid supply source 101 becomes 0 or significantly small, the liquid is supplied to the liquid ejecting portion 41 from the liquid reservoir unit 120. Therefore, while a sufficient amount of liquid is contained in the liquid supply source 101, the amount of the liquid stored in the liquid reservoir unit 120 hardly changes. When the amount of the liquid contained in the liquid supply source 101 becomes small, the amount of the liquid stored in the liquid reservoir unit 120 starts to decrease. In the liquid reservoir unit 120 of the present embodiment, when the reservoir portion 121 is inflated to its maximum, a predetermined amount or more than a predetermined amount of liquid is stored.

In the present embodiment, the liquid is supplied to the liquid reservoir unit 120 by being pressurized from the liquid supply source 101 side. Therefore, while the sufficient amount of liquid is contained in the liquid supply source 101, the reservoir portion 121 is maintained in an inflated state by being pressurized from the upstream. As a result, the liquid reservoir unit 120 stores a predetermined amount or more than a predetermined amount of liquid therein while the liquid is supplied from the liquid supply source 101.

The liquid ejecting apparatus 10 may include an on-off valve 140 and a pressure mechanism 150 as constituent elements of the liquid supply device 100. The on-off valve 140 is configured to open and close the liquid supply flow path 110. The on-off valve 140 is disposed in the liquid supply flow path 110. The on-off valve 140 of the present embodiment is disposed on the liquid supply source 101 side relative to the liquid reservoir unit 120 in the liquid supply flow path 110. Therefore, the on-off valve 140 is located between the liquid reservoir unit 120 and the liquid supply source 101 in the liquid supply flow path 110. When the on-off valve 140 is opened, it is possible for the liquid to flow from the liquid supply source 101 toward the liquid reservoir unit 120. When the on-off valve 140 is closed, the flow of the liquid from the liquid supply source 101 toward the liquid reservoir unit 120 is blocked.

The on-off valve 140 may be, for example, a solenoid valve configured to open and close the valve by a solenoid, or a motor-operated valve configured to open and close the valve by an electric motor. The on-off valve 140 may be a fluid pressure valve configured to open and close the valve by a fluid pressure cylinder, or may be another type of control valve.

The pressure mechanism 150 is configured to apply a negative pressure to the interior of the reservoir portion 121 from the exterior. In order to apply the negative pressure to the interior of the reservoir portion 121 from the exterior, the pressure mechanism 150 of the present embodiment inflates the reservoir portion 121 in such a manner as to increase the volume of the reservoir portion 121.

The pressure mechanism 150 of the present embodiment inflates the reservoir portion 121 to increase the volume of the reservoir portion 121 by depressurizing the outside the reservoir portion 121. When the reservoir portion 121 is inflated, the pressure inside the reservoir portion 121 is reduced. In this manner, the pressure mechanism 150 applies a negative pressure to the interior of the reservoir portion 121 from the outside of the reservoir portion 121. The pressure mechanism 150 may be configured to apply a negative pressure from the exterior to the interior of the reservoir portion 121 by inflating the reservoir portion 121 by using a mechanical element such as a spring or a lever.

The pressure mechanism 150 may include a holding portion 152 having a pressure chamber 151 for accommodating the reservoir portion 121, and a pump 153 for depressurizing the interior of the pressure chamber 151. The pressure mechanism 150 depressurizes the interior of the pressure chamber 151 by using the pump 153, thereby applying a negative pressure to the interior of the reservoir portion 121 from the exterior. When the interior of the pressure chamber 151 is depressurized, the reservoir portion 121 is inflated. As a result, a negative pressure is applied from the outside of the reservoir portion 121 to the interior of the reservoir portion 121. The inflated reservoir portion 121 makes contact with an inner wall 154 of the holding portion 152 forming the pressure chamber 151. The reservoir portion 121, when storing a predetermined amount or more than a predetermined amount of liquid therein, comes into contact with the inner wall 154 of the holding portion 152.

The pressure mechanism 150 of the present embodiment may also pressurize the interior of the pressure chamber 151. When the interior of the pressure chamber 151 is pressurized, the reservoir portion 121 is deflated. The pressure mechanism 150 adjusts the pressure inside the reservoir portion 121 by depressurizing and pressurizing the interior of the pressure chamber 151. The pressure mechanism 150 may be configured to open the pressure chamber 151 to the atmosphere.

The pressure mechanism 150 may include a pressure adjustment flow path 155 coupling the pressure chamber 151 and the pump 153 located outside the holding portion 152. The pump 153 pressurizes or depressurizes the pressure chamber 151 through the pressure adjustment flow path 155. The pump 153 may be located inside the holding portion 152.

The liquid ejecting apparatus 10 includes a discharge mechanism 50 configured to depressurize the liquid supply flow path 110. The discharge mechanism 50 is configured to discharge a liquid in the liquid supply flow path 110 from the liquid ejecting portion 41 side relative to the reservoir portion 121 in the liquid supply flow path 110 by depressurizing the liquid supply flow path 110.

The discharge mechanism 50 of the present embodiment includes a cap 51 configured to cover the nozzle 44 of the liquid ejecting portion 41, and a suction pump 52 for sucking stuff inside the cap 51. The cap 51 is brought into contact with the liquid ejecting portion 41, thereby capping the liquid ejecting portion 41. The capping is to form a space in which the nozzle 44 opens. The capping is performed to suppress drying of the nozzle 44, or the like.

When the suction pump 52 is driven while the cap 51 capping the liquid ejecting portion 41, a negative pressure is applied to the nozzle 44 so that the liquid is forcibly discharged through the nozzle 44. This is called suction cleaning. In other words, the discharge mechanism 50 of the present embodiment depressurizes the liquid supply flow path 110 through the liquid ejecting portion 41, so as to discharge the liquid in the liquid supply flow path 110 as a waste liquid from the liquid ejecting portion 41.

When the suction cleaning is performed, bubbles, foreign objects, and the like within the liquid ejecting portion 41 and the liquid supply flow path 110 are discharged together with the liquid. Therefore, the discharge mechanism 50 depressurizes the liquid supply flow path 110 in order to maintain the liquid ejecting apparatus 10.

The discharge mechanism 50 may include a waste liquid tank 53 for collecting the waste liquid discharged from the liquid ejecting portion 41. With this, for example, the waste liquid having been discharged to the cap 51 by the suction cleaning can be collected by the waste liquid tank 53. The waste liquid tank 53 may directly collect the discharged waste liquid.

The discharge mechanism 50 may include a regulator 54 for adjusting the pressure inside the cap 51. The regulator 54 allows the interior of the cap 51 to communicate with the atmosphere so that the pressure inside the cap 51 is set to a predetermined pressure, which is, for example, −2 kPa to +2 kPa at the capping time. That is, the regulator 54 adjusts the pressure inside the cap 51 to a predetermined pressure by introducing air into the cap 51. The regulator 54 may be an open air valve which is closed when a negative pressure is applied to the nozzle 44, and opened when the interior of the cap 51 is allowed to communication with the atmosphere.

The liquid ejecting apparatus 10 may be configured to perform a maintenance operation in which the liquid supply flow path 110 is depressurized by the discharge mechanism 50 in a state in which the liquid supply flow path 110 is closed by the on-off valve 140. When the liquid supply flow path 110 is depressurized by the discharge mechanism 50 in a state in which the liquid supply flow path 110 is closed by the on-off valve 140, a negative pressure is accumulated in a portion of the liquid supply flow path 110 downstream of the on-off valve 140. When the negative pressure is accumulated in the liquid supply flow path 110, the volume of the bubble in the liquid supply flow path 110 is increased. As a result, the bubbles in the liquid supply flow path 110 are likely to be discharged.

In the present embodiment, the liquid is discharged through the nozzle 44 by opening the on-off valve 140 in a state where the negative pressure is accumulated in the liquid supply flow path 110. As discussed above, the operation in which a negative pressure generated by the discharge mechanism 50 depressurizing the liquid supply flow path 110 is accumulated first, and then the liquid in the liquid supply flow path 110 is vigorously discharged through the nozzle 44 by the accumulated negative pressure, is generally referred to as choke cleaning. The choke cleaning is performed to maintain the liquid ejecting apparatus 10. When the choke cleaning is performed, bubbles, foreign objects, and the like in the liquid ejecting portion 41 and in the liquid supply flow path 110 are discharged together with the liquid. The choke cleaning is performed mainly for the purpose of discharging the bubbles, foreign objects, and the like in the liquid supply flow path 110.

In the liquid ejecting apparatus 10 of the present embodiment, when the choke cleaning is to be performed, the on-off valve 140 is closed first. Subsequently, the liquid supply flow path 110 is depressurized from the liquid ejecting portion 41 side by the discharge mechanism 50. With this, a negative pressure is accumulated in a portion of the liquid supply flow path 110 closer to the liquid ejecting portion 41 relative to the on-off valve 140, that is, in a portion of the liquid supply flow path 110 located downstream of the on-off valve 140. Next, the on-off valve 140 is opened. As a result, the liquid is vigorously discharged through the nozzle 44 by the depressurization of the discharge mechanism 50.

In the maintenance operation, when the liquid supply flow path 110 is depressurized by the discharge mechanism 50 in a state where the liquid supply flow path 110 is closed by the on-off valve 140, the reservoir portion 121 is also depressurized. When a negative pressure is applied to the interior of the reservoir portion 121 by the depressurization of the discharge mechanism 50, the liquid flows out of the reservoir portion 121 in some cases. In this case, the liquid stored in the reservoir portion 121 is consequently discharged in order to discharge the bubbles, foreign objects, and the like in the liquid supply flow path 110. Therefore, the amount of liquid consumption involved in the maintenance is increased.

When the liquid flows out of the reservoir portion 121 by the depressurization of the discharge mechanism 50, a negative pressure is unlikely to be accumulated in the liquid supply flow path 110. In particular, in a case in which the reservoir portion 121 is formed of the bag-like member 122, when the depressurization by the discharge mechanism 50 is applied to the interior of the reservoir portion 121, the reservoir portion 121 is deflated so that its volume becomes smaller. In this case, when it is attempted to accumulate a sufficient negative pressure in the liquid supply flow path 110, most of the liquid in the reservoir portion 121 flows out resulting from the deflation of the reservoir portion 121. In other words, when the choke cleaning is performed in such a state, since most of the liquid stored in the reservoir portion 121 is discharged, the amount of liquid consumption is likely to become large.

The liquid ejecting apparatus 10 may operate in such a manner as to reduce the amount of liquid consumption in the maintenance operation. For example, in the maintenance operation, the control portion 60 may control the pressure mechanism 150 so that a negative pressure equal to or larger than a negative pressure applied to the interior of the reservoir portion 121 by the depressurization of the discharge mechanism 50 is applied to the interior of the reservoir portion 121. At this time, the negative pressure applied to the interior of the reservoir portion 121 by the depressurization of the discharge mechanism 50 is, for example, −50 kPa with respect to the atmospheric pressure. In the maintenance operation, the control portion 60 controls the pressure mechanism 150 so that a negative pressure of −60 kPa, for example, is applied to the interior of the reservoir portion 121 as a negative pressure equal to or larger than −50 kPa. In other words, the pressure mechanism 150 acts to apply a pressure smaller than the pressure applied to the interior of the reservoir portion 121 by the depressurization of the discharge mechanism 50, to the interior of the reservoir portion 121 from the exterior. This reduces a risk that the liquid flows out of the reservoir portion 121 due to the depressurization of the discharge mechanism 50.

In the maintenance operation, the pressure mechanism 150 of the present embodiment acts to apply a negative pressure to the interior of the reservoir portion 121 from the exterior in such a manner that the reservoir portion 121 is not deflated due to the depressurization of the discharge mechanism 50. For example, in the maintenance operation, the pressure mechanism 150 depressurizes the pressure chamber 151 so that the reservoir portion 121 makes contact with the inner wall 154 of the holding portion 152. With this, in the maintenance operation, it is possible to maintain the amount of the liquid stored in the reservoir portion 121 at a level of a predetermined amount or more than a predetermined amount.

The pressure mechanism 150 pressurizes the interior of the reservoir portion 121 by sending a gas to the pressure chamber 151 when the empty reservoir portion 121 is to be filled with the liquid. When the interior of the reservoir portion 121 is pressurized, the air in the reservoir portion 121 is discharged. This makes it possible for the reservoir portion 121 to be filled with the liquid. The pressure mechanism 150 acts in such a manner that, when the amount of the liquid in the liquid supply source 101 becomes small, the liquid is supplied from the reservoir portion 121 by starting to pressurize the interior of the reservoir portion 121.

Next, the liquid supply device 100 of the present embodiment will be described.

The liquid supply device 100 may include a liquid supply source holding portion 102 configured to hold the liquid supply source 101 serving as a liquid supply source to the liquid ejecting portion 41. It is sufficient that the liquid supply source 101 is configured to contain a liquid, and therefore the liquid supply source 101 may be, for example, a replaceable cartridge type, or a tank type able to replenish the liquid. The liquid supply source 101 is so provided as to correspond to the number of liquid types used by the liquid ejecting apparatus 10.

The liquid supply flow path 110 of the present embodiment includes a first liquid flow path 111 and a second liquid flow path 112. The first liquid flow path 111 couples the liquid supply source 101 and the liquid reservoir unit 120. The second liquid flow path 112 couples the liquid reservoir unit 120 and the liquid ejecting portion 41. The first liquid flow path 111 and the second liquid flow path 112 are coupled to the connection body 123 of the liquid reservoir unit 120.

It is sufficient for the liquid supply flow path 110 to be a flow path that allows a liquid to flow therethrough. The liquid supply flow path 110 may be formed of, for example, an elastically deformable tube, or may be formed of a flow-path forming member made of a hard resin material. The liquid supply flow path 110 may be formed by pasting a film member on a flow-path forming member in which a groove is formed.

The liquid supply device 100 may include a pressurization mechanism 170 configured to pressurize a liquid toward the liquid ejecting portion 41. The pressurization mechanism 170 is disposed in the liquid supply flow path 110. The pressurization mechanism 170 is located between the liquid supply source 101 and the liquid reservoir unit 120 in the liquid supply flow path 110. Therefore, the pressurization mechanism 170 of the present embodiment is disposed in the first liquid flow path 111. The liquid in the liquid supply source 101 is supplied to the liquid ejecting portion 41 via the liquid reservoir unit 120 by the pressurization mechanism 170.

The pressurization mechanism 170 of the present embodiment includes a volume pump 171, a first valve 172, and a second valve 173. The first valve 172 is located upstream of the volume pump 171 in the liquid supply flow path 110. The second valve 173 is located downstream of the volume pump 171 in the liquid supply flow path 110. The first valve 172 and the second valve 173 of the present embodiment are one-way valves that allow the liquid to flow from the upstream toward the downstream in the liquid supply flow path 110, and restrict a liquid flow from the downstream toward the upstream. Similarly to the on-off valve 140, the first valve 172 and the second valve 173 may be configured to open and close the liquid supply flow path 110.

The volume pump 171 is configured to apply pressure to a liquid by reciprocating a flexible film 174 having flexibility. The volume pump 171 includes a pump chamber 175 and a negative pressure chamber 176 that are separated by the flexible film 174. The volume pump 171 includes a depressurization portion 177 for depressurizing the negative pressure chamber 176, and a pressing member 178 for pressing the flexible film 174 toward the pump chamber 175 side. The pressing member 178 is disposed in the negative pressure chamber 176.

When the depressurization portion 177 depressurizes the negative pressure chamber 176, the flexible film 174 is displaced so that the volume of the pump chamber 175 becomes larger. At this time, the liquid is drawn from the liquid supply source 101 into the pump chamber 175. When the depressurizing of the negative pressure chamber 176 by the depressurization portion 177 is stopped, the flexible film 174 is pressed by the pressing member 178, whereby the flexible film 174 is displaced so that the volume of the pump chamber 175 is reduced. At this time, the liquid is pushed out from the pump chamber 175. That is, the volume pump 171 of the present embodiment is constituted by a diaphragm pump. The volume pump 171 may be configured by a tube pump.

The pressurization mechanism 170 pressurizes the liquid by the pressing member 178 pressing the liquid in the pump chamber 175 via the flexible film 174. With this, the pressurization mechanism 170 supplies the liquid toward the liquid ejecting portion 41. A pressurizing force of the pressurization mechanism 170 for pressurizing the liquid is set by a pressing force of the pressing member 178.

The liquid supply device 100 may be configured to supply the liquid from the liquid supply source 101 to the liquid ejecting portion 41 by utilizing a water head difference. In this case, the pressurization mechanism 170 may not be provided.

The liquid supply device 100 may include a first filter portion 210, a second filter portion 220, a third filter portion 230, a static mixer 250, a liquid reservoir portion 260, a degassing mechanism 270, and a hydraulic pressure adjustment mechanism 280. The first filter portion 210, the second filter portion 220, the third filter portion 230, the static mixer 250, the liquid reservoir portion 260, the degassing mechanism 270, and the hydraulic pressure adjustment mechanism 280 are disposed in the liquid supply flow path 110, and are located between the liquid reservoir unit 120 and the liquid ejecting portion 41. In the present embodiment, the first filter portion 210, the static mixer 250, the liquid reservoir portion 260, the degassing mechanism 270, the second filter portion 220, the hydraulic pressure adjustment mechanism 280, and the third filter portion 230 are disposed in that order from the upstream in the second liquid flow path 112.

In the first filter portion 210, the second filter portion 220, and the third filter portion 230, the collected foreign objects increase as the operating time increases. For this reason, the liquid ejecting apparatus 10 may be configured such that at least one of the first filter portion 210, the second filter portion 220, and the third filter portion 230 is replaceable. For example, as illustrated in FIG. 2, the first filter portion 210 may be provided at a position exposed from the housing 12 when a cover 18 of the housing 12 is opened.

As illustrated in FIG. 3, the first filter portion 210 includes a first filter 211 for collecting foreign objects, a first upstream filter chamber 212 positioned upstream of the first filter 211, and a first downstream filter chamber 213 positioned downstream of the first filter 211. The first upstream filter chamber 212 is positioned on a lower side relative to the first downstream filter chamber 213. The first upstream filter chamber 212 is provided being formed in a substantially conical shape or a substantially truncated conical shape. The first filter 211 is formed in a substantially disk shape to form a bottom surface of the first upstream filter chamber 212. The height of the first upstream filter chamber 212 may be smaller than the diameter of the first filter 211.

The second filter portion 220 includes a second filter 221 for collecting foreign objects, a second upstream filter chamber 222 positioned upstream of the second filter 221, and a second downstream filter chamber 223 positioned downstream of the second filter 221.

The third filter portion 230 includes a third filter 231 for collecting foreign objects, a third upstream filter chamber 232 positioned upstream of the third filter 231, and a third downstream filter chamber 233 positioned downstream of the third filter 231.

The first filter 211, the second filter 221, and the third filter 231 may be formed such that a filtration area through which the liquid can pass is larger than a flow path cross-section area of the liquid supply flow path 110. As the first filter 211, the second filter 221 and the third filter 231, for example, a mesh-formed member, a porous member, a perforated plate having fine through-holes formed therein, and the like may be used. As the first filter 211, the second filter 221 and the third filter 231, filters of different types and different shapes may be used.

Examples of the filter of the mesh-formed member include a wire mesh, a resin mesh, a mesh filter, and a metal fiber. Examples of the filter of the metal fiber include a felt filter in which thin stainless steel wires are processed to be in a felt form, and a metal-sintered filter in which thin stainless steel wires are compressed and sintered. Examples of the perforated plate filter include an electroforming metal filter, an electron beam-processed metal filter, and a laser beam-processed metal filter.

The static mixer 250 has a plurality of configurations for dividing the flow of a liquid in a direction in which the liquid flows. The static mixer 250 is configured to divide, change, or reverse the flow of the liquid in the static mixer 250, thereby reducing unevenness of the concentration in the liquid.

The liquid reservoir portion 260 includes a pressurization chamber 261 for storing a liquid, an elastic film 262 forming part of a wall surface of the pressurization chamber 261, and a first pressing member 263 for pressing the elastic film 262 in a direction in which the volume of the pressurization chamber 261 is reduced. The liquid stored in the pressurization chamber 261 is pressurized by the first pressing member 263.

The liquid reservoir portion 260 pressurizes the liquid stored in the pressurization chamber 261 at a pressure lower than a pressure at which the liquid is pressurized by the pressurization mechanism 170 when the liquid is supplied to the liquid ejecting portion 41. The pressure at which the liquid is pressurized by the pressurization mechanism 170 when the liquid is supplied to the liquid ejecting portion 41 is, for example, 30 kPa. Accordingly, the liquid reservoir portion 260 pressurizes the liquid stored in the pressurization chamber 261 at a pressure of, for example, 10 kPa. Specifically, the pressure applied to the liquid stored in the pressurization chamber 261 by the elastic film 262 being pressed by the first pressing member 263 is lower than the pressure applied by the pressurization mechanism 170 to supply the liquid from the liquid supply source 101 toward the liquid ejecting portion 41. Because of this, when the pressure for supplying the liquid from the liquid supply source 101 is not lowered until the arrival at the liquid reservoir portion 260, the elastic film 262 is displaced in a direction in which the volume of the pressurization chamber 261 is increased against the pressing force of the first pressing member 263.

The degassing mechanism 270 includes a degassing chamber 271 for temporarily storing a liquid, an exhaust chamber 273 separated from the degassing chamber 271 by a degassing film 272, and an exhaust path 274 for allowing the exhaust chamber 273 to communicate with the exterior.

The degassing film 272 has a property of allowing a gas to pass therethrough but not allowing a liquid to pass therethrough. As the degassing film 272, for example, a film produced in such a manner may be employed that a large number of fine pores of about 0.2 μm are formed in a film prepared by subjecting polytetrafluoroethylene to a special stretching process. When a liquid containing a gas flows into the degassing chamber 271, only the gas passes through the degassing film 272 and enters into the exhaust chamber 273. The gas having entered the exhaust chamber 273 is discharged to the exterior through the exhaust path 274. Thus, bubbles and dissolved gases that are mixed in the liquid stored in the degassing chamber 271 are removed.

In the degassing mechanism 270, the exhaust chamber 273 may be positioned above the degassing chamber 271. Bubbles and dissolved gases mixed in a liquid are likely to float in the liquid. Therefore, when the exhaust chamber 273 is positioned above the degassing chamber 271, the bubbles and dissolved gases mixed in the liquid are likely to be removed.

The degassing mechanism 270 may include a depressurization pump 275 for depressurizing the exhaust chamber 273. The depressurization pump 275 depressurizes the exhaust chamber 273 through the exhaust path 274 to remove the bubbles and dissolved gases that are mixed in the liquid stored in the degassing chamber 271. For example, when it is possible to make the pressure in the exhaust chamber 273 lower than the pressure in the degassing chamber 271 by using a member such as a spring, the depressurization pump 275 may not be provided. In this embodiment, the pressurization of the pressurization mechanism 170 causes the pressure in the degassing chamber 271 to be higher than the pressure in the exhaust chamber 273.

The hydraulic pressure adjustment mechanism 280 of the present embodiment is provided integrally with the second filter portion 220 at a position downstream of the second filter portion 220. The hydraulic pressure adjustment mechanism 280 includes a liquid chamber 282 communicating with the second downstream filter chamber 223 through a communication hole 281, and a valve body 283 enable to open and close the communication hole 281. The hydraulic pressure adjustment mechanism 280 includes a pressure receiving member 284 whose base end side is accommodated in the second downstream filter chamber 223 and whose leading end side is accommodated in the liquid chamber 282.

The liquid chamber 282 of the hydraulic pressure adjustment mechanism 280 is able to store a liquid. Part of a wall surface of the liquid chamber 282 is formed by a flexible wall 285 that can be deflected and displaced. The valve body 283 may be an elastic body such as rubber or resin attached to the base end portion of the pressure receiving member 284 located in the second downstream filter chamber 223.

The hydraulic pressure adjustment mechanism 280 includes a second pressing member 286 accommodated in the second downstream filter chamber 223, and a third pressing member 287 accommodated in the liquid chamber 282. The second pressing member 286 presses the valve body 283 in a direction in which the communication hole 281 is closed via the pressure receiving member 284. The third pressing member 287 pushes back the pressure receiving member 284 when the flexible wall 285 pushes the pressure receiving member 284 by the flexible wall 285 being deflected and displaced in a direction in which the volume of the liquid chamber 282 is reduced.

Due to a drop in the internal pressure of the liquid chamber 282, when the force of the flexible wall 285 pushing the pressure receiving member 284 exceeds the pressing force of the second pressing member 286 and the third pressing member 287, the valve body 283 opens the communication hole 281. When the liquid flows into the liquid chamber 282 from the second downstream filter chamber 223 by the communication hole 281 being opened, the internal pressure of the liquid chamber 282 rises. As a result, before the internal pressure of the liquid chamber 282 rises up to a positive pressure, the valve body 283 closes the communication hole 281 by the pressing force of the second pressing member 286 and the third pressing member 287. In this manner, the internal pressure of the liquid chamber 282 is maintained within a negative pressure range corresponding to the pressing force of the second pressing member 286 and the third pressing member 287.

The internal pressure of the liquid chamber 282 drops along with the discharge of the liquid from the liquid ejecting portion 41. The valve body 283 autonomously opens and closes the communication hole 281 in accordance with a difference in pressure between the atmospheric pressure, which is an external pressure of the liquid chamber 282, and the internal pressure of the liquid chamber 282. Therefore, the hydraulic pressure adjustment mechanism 280 is a differential pressure regulating valve. The differential pressure regulating valve is also referred to as a pressure reducing valve or a self-sealing valve.

A valve opening mechanism 290 configured to forcibly open the communication hole 281 to supply the liquid to the liquid ejecting portion 41 may be added to the hydraulic pressure adjustment mechanism 280. For example, the valve opening mechanism 290 includes a pressurization bag 292 accommodated in an accommodation chamber 291 separated from the liquid chamber 282 by the flexible wall 285, and a pressurization flow path 293 for allowing a gas to flow into the pressurization bag 292.

The pressurization bag 292 is expanded by the gas flowing thereinto through the pressurization flow path 293, and the flexible wall 285 is caused to be deflected and displaced in a direction in which the volume of the liquid chamber 282 is reduced, whereby the valve opening mechanism 290 forcibly opens the communication hole 281. The liquid supply device 100 can perform pressure cleaning in which a liquid is flowed out from the liquid ejecting portion 41, by pressurizing and supplying the liquid from the liquid supply source 101 to the liquid ejecting portion 41 in a state in which the communication hole 281 is opened.

When the liquid supply device 100 is provided with the depressurization pump 275, the depressurization pump 275 may be shared by the valve opening mechanism 290 and the degassing mechanism 270. For example, the pressurization flow path 293 may be coupled to the exhaust path 274, and the depressurization pump 275 may be configured to perform both pressurization driving and depressurization driving. In this case, a check valve 187 may be provided in the exhaust path 274. In such a configuration, the depressurization pump 275 may perform the pressurization driving to send the gas to the pressurization bag 292, or the depressurization pump 275 may perform the depressurization driving to depressurize the exhaust chamber 273.

Next, the liquid reservoir unit 120 and the pressure mechanism 150 will be described.

The liquid reservoir unit 120 is so provided as to correspond to the number of liquid supply sources 101. In other words, the liquid reservoir unit 120 is so provided as to correspond to the number of liquid types used by the liquid ejecting apparatus 10. For example, one liquid reservoir unit 120 may be provided corresponding to one liquid supply source 101, or two liquid reservoir units 120 may be provided corresponding to one liquid supply source 101.

Figure 4:
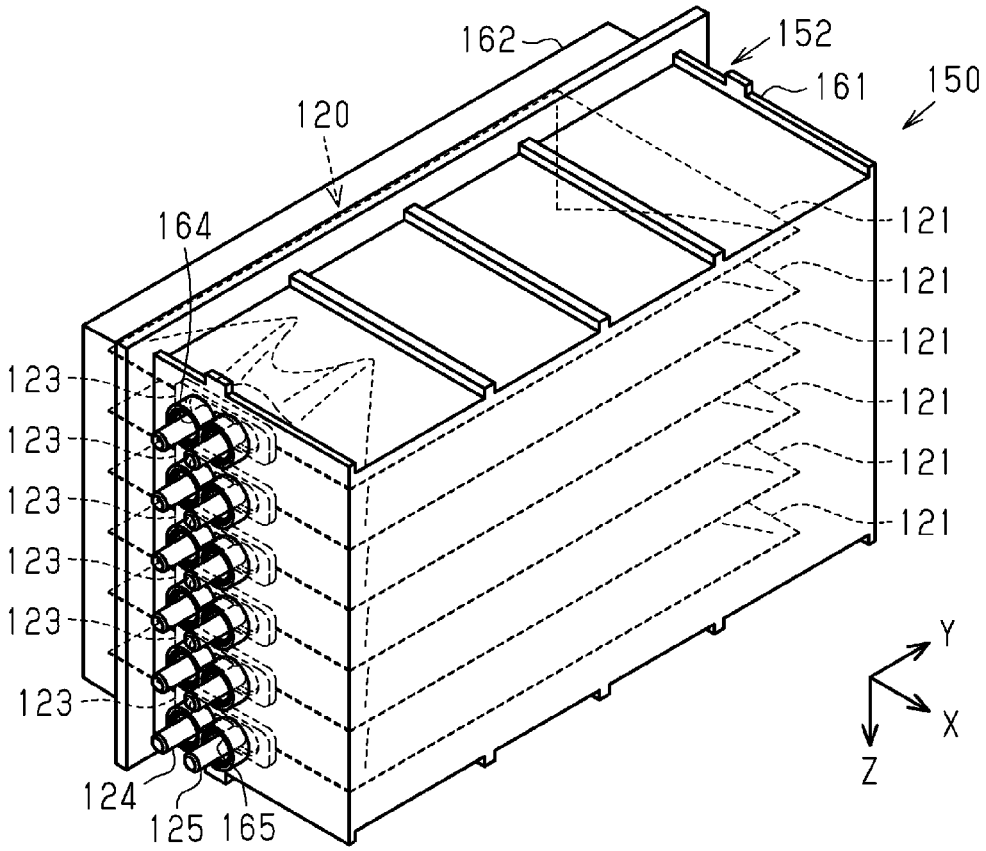
FIG. 4 is a perspective view of a liquid reservoir unit and a holding portion.

As illustrated in FIG. 4, in the present embodiment, a plurality of liquid reservoir units 120 is provided. The holding portion 152 of the pressure mechanism 150 is configured to hold the liquid reservoir unit 120. The holding portion 152 of the present embodiment is configured to hold the plurality of liquid reservoir units 120. The holding portion 152 may be configured to hold one liquid reservoir unit 120. In this case, a plurality of holding portions 152 may be provided so as to correspond to the plurality of liquid reservoir units 120.

The holding portion 152 of the present embodiment includes a case 161 and a cover 162. The case 161 and the cover 162 are attached to each other so as to constitute the pressure chamber 151.

Figure 5:
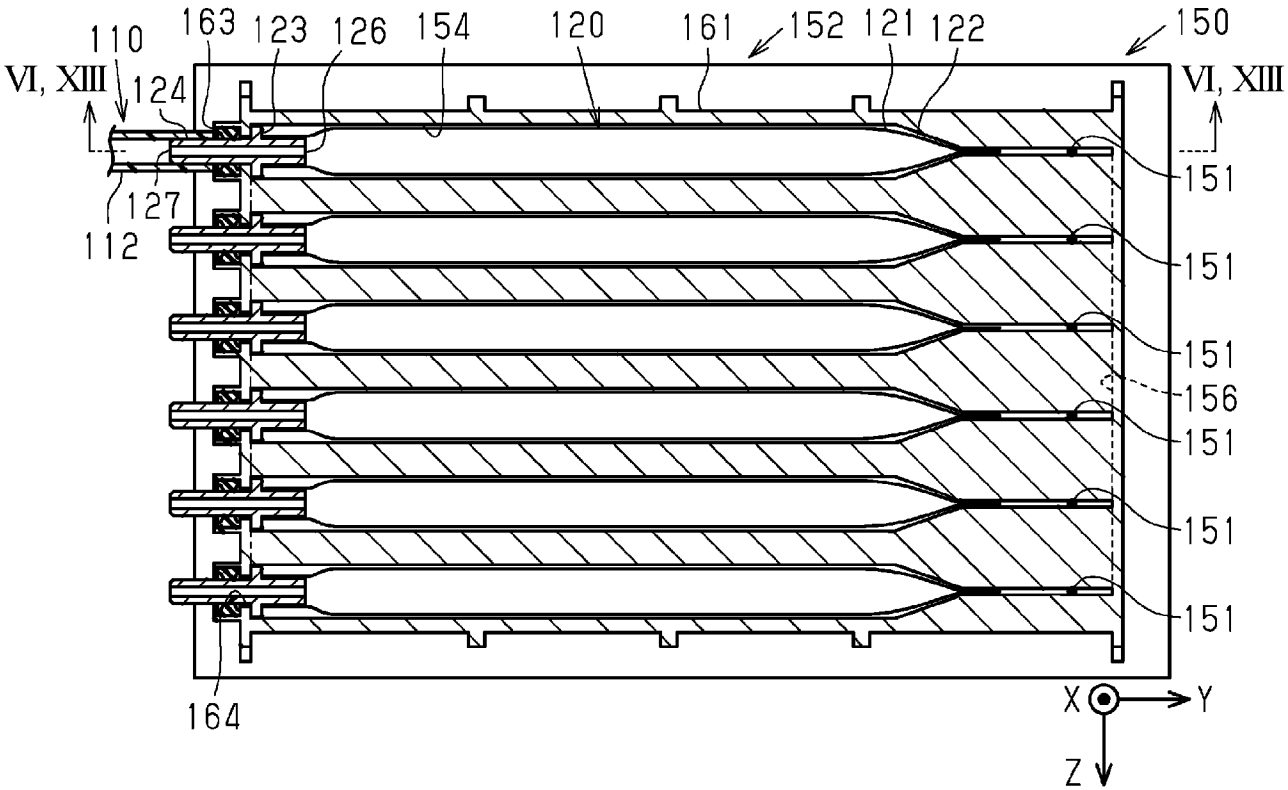
FIG. 5 is a cross-sectional view of a liquid reservoir unit and a holding portion.

As illustrated in FIG. 5, the holding portion 152 of the present embodiment includes a plurality of pressure chambers 151. In the holding portion 152, the plurality of pressure chambers 151 is positioned to be aligned in a vertical direction. In the holding portion 152, the plurality of pressure chambers 151 may be positioned to be aligned in the width direction or the depth direction of the liquid ejecting apparatus 10. The holding portion 152 of the present embodiment includes six pressure chambers 151. Therefore, the holding portion 152 is configured to hold six liquid reservoir units 120.

The plurality of pressure chambers 151 is configured in such a manner that their spaces are connected to each other by a slit 156 provided in the holding portion 152. Therefore, when the pump 153 depressurizes one pressure chamber 151, the other pressure chambers 151 are also depressurized. When the pump 153 pressurizes one pressure chamber 151, the other pressure chambers 151 are also pressurized.

The pressure mechanism 150 may include the pump 153 for each of the pressure chambers 151. In this case, the pressure can be adjusted for each of the pressure chambers 151. The pressure mechanism 150 pressurizes the interior of the reservoir portion 121 by the pump 153 sending a gas to the pressure chamber 151 of the holding portion 152, and applies a negative pressure to the interior of the reservoir portion 121 by the pump 153 discharging the gas from the pressure chamber 151 of the holding portion 152.

The inner wall 154 of the holding portion 152 forming the pressure chamber 151 may be so disposed as to be in contact with the reservoir portion 121 having been displaced to have a larger volume. This makes it possible to suppress excessive displacement of the reservoir portion 121. In other words, it is possible to suppress an excessive inflation of the bag-like member 122. Accordingly, damage to the reservoir portion 121 due to the excessive displacement may be reduced.

Figure 6:
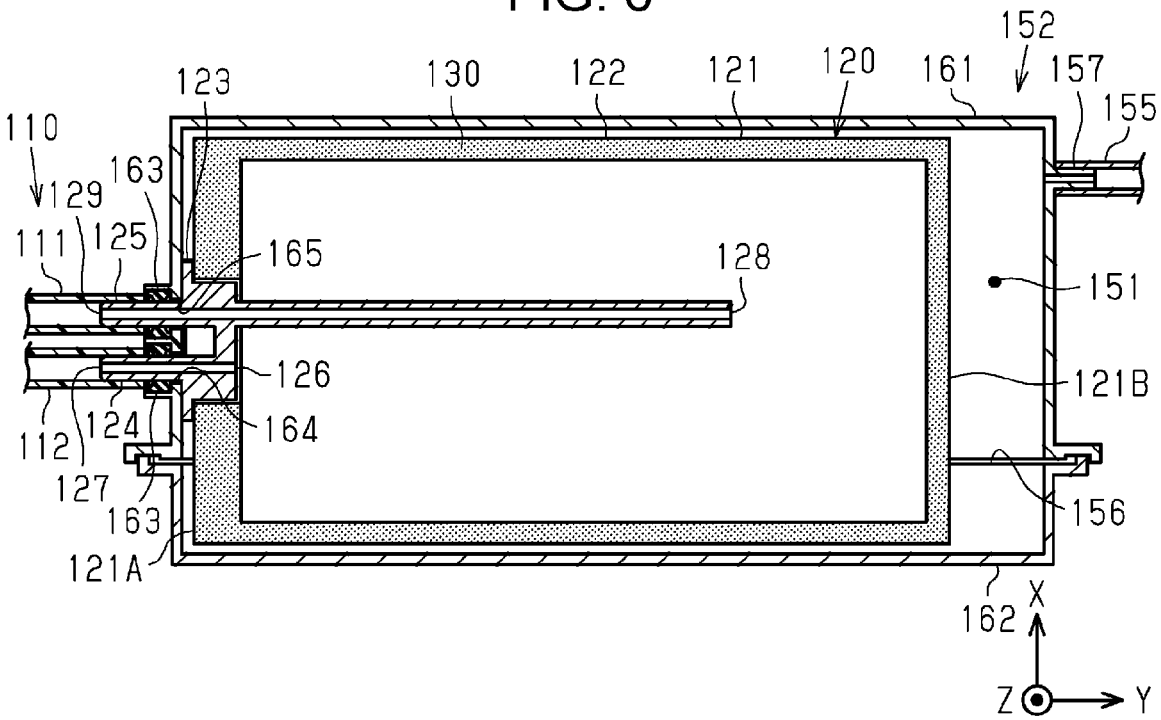
FIG. 6 is a cross-sectional view taken along a line VI-VI in FIG. 5.

As illustrated in FIG. 6, the liquid reservoir unit 120 includes an outflow portion 124 configured to cause a liquid to flow out of the reservoir portion 121, and an inflow portion 125 configured to cause the liquid to flow into the reservoir portion 121. The outflow portion 124 and the inflow portion 125 may be disposed at a position near a first end 121A in the reservoir portion 121. The first end 121A of the reservoir portion 121 refers to an end portion through which the liquid flows into or flows out of the reservoir portion 121.

The liquid reservoir unit 120 has predetermined lengths as its width, depth, and height in a state of being installed on a place where it is used. In the reservoir portion 121, an end portion on the opposite side to the first end 121A is a second end 121B. The direction from the first end 121A toward the second end 121B is a depth direction of the liquid reservoir unit 120.

The outflow portion 124 has an outflow opening 126 opened to the interior of the reservoir portion 121. The outflow portion 124 has a lead-out opening 127 opened to the outside of the reservoir portion 121. The inflow portion 125 has an inflow opening 128 opened to the interior of the reservoir portion 121. The inflow portion 125 has an introduction opening 129 opened to the outside of the reservoir portion 121.

The outflow opening 126 and the lead-out opening 127 communicate with each other in the outflow portion 124. The outflow portion 124 is provided being formed in, for example, a tubular shape, and extends to pass through the first end 121A of the reservoir portion 121. In the outflow portion 124, the outflow opening 126 is provided at one end, and the lead-out opening 127 is provided at the other end.

The inflow opening 128 and the introduction opening 129 communicate with each other in the inflow portion 125. The inflow portion 125 is provided being formed in, for example, a tubular shape, and extends to pass through the first end 121A of the reservoir portion 121. In the inflow portion 125, the inflow opening 128 is provided at one end, and the introduction opening 129 is provided at the other end.

The outflow portion 124 and the inflow portion 125 of the present embodiment are integrally provided as the connection body 123. The outflow portion 124 and the inflow portion 125 may be provided independently.

The outflow opening 126 and the inflow opening 128 are located at different positions in the depth direction from the first end 121A toward the second end 121B. With this, the liquid flows in the reservoir portion 121 from the inflow opening 128 toward the outflow opening 126 in the depth direction. In this process, the liquid is stirred in the reservoir portion 121. As a result, the settling of liquid components in the reservoir portion 121 is suppressed.

The inflow opening 128 may be opened facing the second end 121B. With this, the liquid coming from the inflow portion 125 flows toward the inner wall of the reservoir portion 121 near the second end 121B. As a result, the liquid in the reservoir portion 121 may be effectively stirred. In the present embodiment, both the inflow opening 128 and the outflow opening 126 are opened facing the second end 121B.

The outflow opening 126 may be opened to a position closer to the first end 121A than to the second end 121B. That is, the outflow opening 126 may be opened to a position near the first end 121A in the depth direction. The inflow opening 128 may be opened to a position closer to the second end 121B than to the first end 121A. That is, the inflow opening 128 may be opened to a position near the second end 121B in the depth direction. With this, the length of the outflow portion 124 in the depth direction is shorter than the length of the inflow portion 125 in the depth direction. In other words, in the depth direction, the length from the lead-out opening 127 to the outflow opening 126 in the outflow portion 124 is shorter than the length from the introduction opening 129 to the inflow opening 128 in the inflow portion 125. This reduces the amount of the liquid staying in the outflow portion 124. As a result, the amount of the liquid in which liquid components settle is reduced in the outflow portion 124.

The outflow portion 124 is coupled to part of the liquid supply flow path 110 closer to the liquid ejecting portion 41. The outflow portion 124 of the present embodiment is coupled to the second liquid flow path 112, which is closer to the liquid ejecting portion 41 in the liquid supply flow path 110. The inflow portion 125 is coupled to part of the liquid supply flow path 110 closer to the liquid supply source 101. The inflow portion 125 of the present embodiment is coupled to the first liquid flow path 111, which is closer to the liquid supply source 101 in the liquid supply flow path 110.

The holding portion 152 includes a pressure adjustment tube 157 to which the pressure adjustment flow path 155 is coupled. The pressure adjustment tube 157 is configured to communicate with the pressure chamber 151. In the present embodiment, one pressure adjustment tube 157 is provided in the holding portion 152. The pressure adjustment tube 157 of the present embodiment is configured to communicate with one pressure chamber 151 located at the uppermost position in the holding portion 152. The slit 156 is formed by a gap between the case 161 and the cover 162 attached to each other.

The case 161 has a first opening 164 and a second opening 165 for exposing the outflow portion 124 and the inflow portion 125 to the exterior. The outflow portion 124 extends from the interior of the holding portion 152 to the outside of the holding portion 152 through the first opening 164. Through the second opening 165, the inflow portion 125 extends from the interior of the holding portion 152 to the outside of the holding portion 152. The first opening 164 may be provided in the cover 162. The second opening 165 may be provided in the cover 162.

The holding portion 152 includes a sealing member 163. The sealing member 163 seals the pressure chamber 151 in which the liquid reservoir unit 120 is accommodated. The sealing member 163 of the present embodiment seals gaps between the outflow portion 124 and inflow portion 125, and the first opening 164 and second opening 165. As a result, the pressure chamber 151 becomes a sealed space.

The reservoir portion 121 constituted by the bag-like member 122 may be formed by bonding flexible sheets. An edge portion of the reservoir portion 121 is referred to as a bonding portion 130 where flexible sheets are bonded to each other. The bonding portion 130 may be bonded by an adhesive agent, or may be welded by heat or solvent. The connection body 123 is positioned in such a manner as to be pinched by the bonding portion 130, and is bonded to the bonding portion 130.

Figure 7:
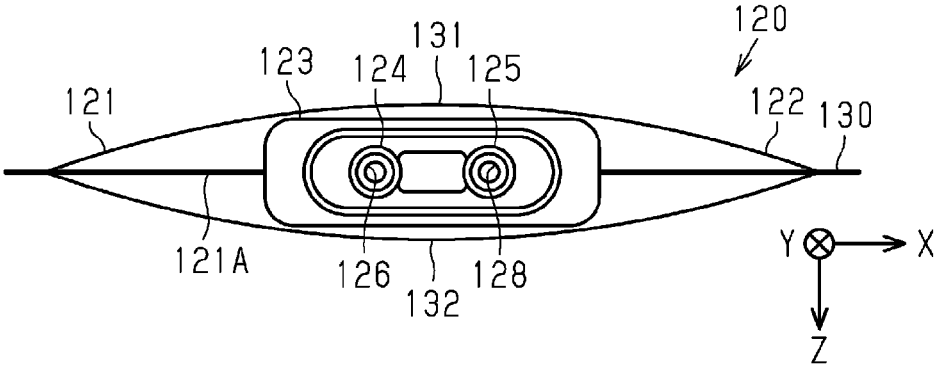
FIG. 7 is a front view of a reservoir portion in an inflated state when seen from a first end.
Figure 8:
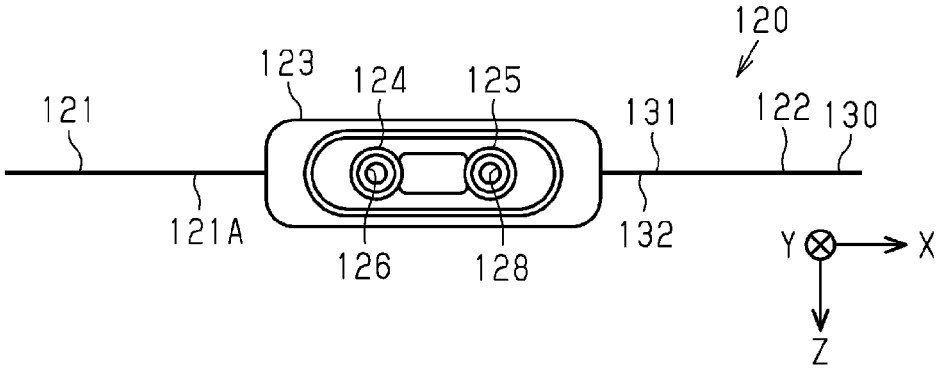
FIG. 8 is a front view of a reservoir portion in a deflated state when seen from a first end.

As illustrated in FIG. 7 and FIG. 8, the reservoir portion 121 is inflated or deflated by two opposing walls being separated from each other or approaching each other. In the reservoir portion 121, the two opposing walls are referred to as a first wall 131 and a second wall 132, respectively.

The reservoir portion 121 is displaced between an expansion state in which it is inflated and a flat state in which it is deflated, in accordance with the amount of the liquid stored therein. For example, the reservoir portion 121 is in the expansion state when the amount of the stored liquid is at its maximum, or in the flat state when the amount of the stored liquid is 0. In the expansion state, the first wall 131 and the second wall 132 are separated from each other. In the flat state, the first wall 131 and the second wall 132 approach each other. In the flat state, the reservoir portion 121 is formed in a flat shape.

The outflow opening 126 and the inflow opening 128 are located at different positions in the width direction, which is a lengthwise direction of the reservoir portion 121 when the reservoir portion 121 is viewed from the first end 121A. In the present embodiment, the outflow opening 126 and the inflow opening 128 are located to be aligned in the width direction. In the present embodiment, the lengthwise direction of the reservoir portion 121 when the reservoir portion 121 is viewed from the first end 121A, coincides with a direction in which the first wall 131 and the second wall 132 extend in the flat state.

The holding portion 152 may hold the liquid reservoir unit 120 in such a manner that the height direction, which is a short-length direction of the reservoir portion 121 when the reservoir portion 121 is viewed from the first end 121A, is taken as a vertical direction. In the present embodiment, the short-length direction of the reservoir portion 121 when the reservoir portion 121 is viewed from the first end 121A is a direction in which the first wall 131 and the second wall 132 are displaced. In this case, the liquid reservoir unit 120 is disposed such that the reservoir portion 121 becomes flat on a plane along the X-axis and the Y-axis. In other words, the liquid reservoir unit 120 of the present embodiment is arranged in a horizontally placed state.

The holding portion 152 of the present embodiment holds the liquid reservoir unit 120 in a horizontally placed state. The holding portion 152 may hold the liquid reservoir unit 120 in a vertically placed state in which the reservoir portion 121 becomes flat on a plane along the Y-axis and the Z-axis. The holding portion 152 may hold the liquid reservoir unit 120 in a vertically placed state in which the reservoir portion 121 becomes flat on a plane along the Z-axis and the X axis. The holding portion 152 may hold the liquid reservoir unit 120 in a posture in which the first end 121A of the reservoir portion 121 comes to be a lower end of the reservoir portion 121. The holding portion 152 may hold the liquid reservoir unit 120 in a posture in which the second end 121B of the reservoir portion 121 comes to be the lower end of the reservoir portion 121.

The reservoir portion 121 is configured such that the size thereof in the direction in which the first wall 131 and the second wall 132 extend in the flat state is larger than the size thereof in the direction in which the first wall 131 and the second wall 132 are displaced.

Next, an example of a maintenance method for maintenance of the liquid ejecting apparatus 10 will be described.

When a liquid stays in the reservoir portion 121, components of the liquid settle. At this time, when the liquid in which the components thereof have settled is used for printing, color unevenness, uneven drying, and the like are caused by unevenness of the concentration, which affects the print quality. Therefore, as a maintenance method for the liquid ejecting apparatus 10, the control portion 60 controls the discharge mechanism 50 to discharge the liquid stored in the reservoir portion 121 as a waste liquid when a stay of the liquid in the reservoir portion 121 exceeds a set time.

The set time is a period of time, after the passage of which the print quality may be affected by the settling of the liquid components. The control portion 60 counts the time since when the liquid was stored in the reservoir portion 121. When the stay of the liquid in the reservoir portion 121 exceeds the set time, the control portion 60 performs, for example, suction cleaning to discharge the liquid stored in the reservoir portion 121 as a waste liquid.

When print data is input, the control portion 60 of the present embodiment performs a printing process to print an image based on the print data. In the printing process, the control portion 60 refers to a time for which the liquid has stayed in the reservoir portion 121.

Figure 9:
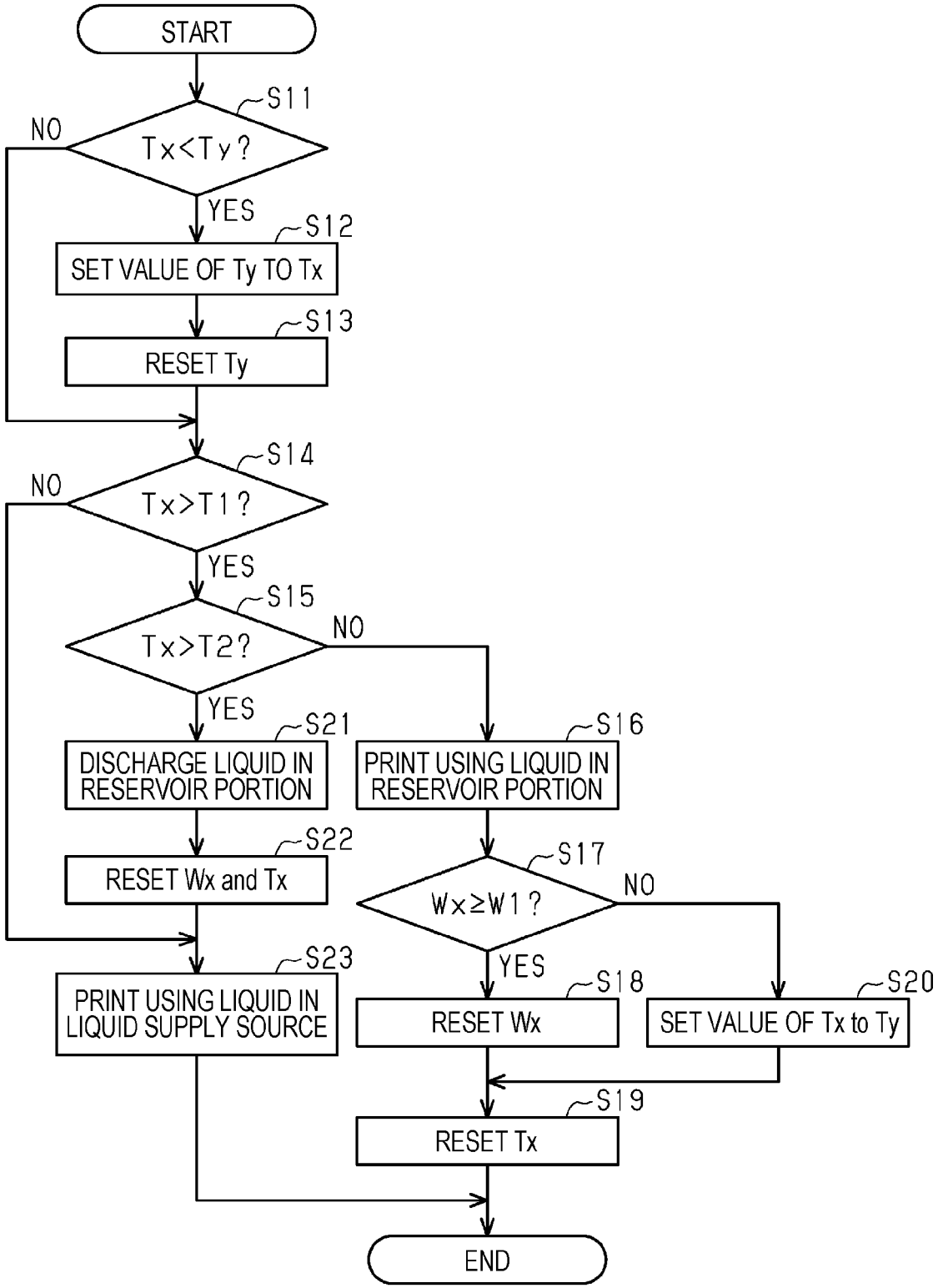
FIG. 9 is a flowchart of a printing process.

As illustrated in FIG. 9, in step S11, the control portion 60 in charge of performing the printing process determines whether or not a staying time Tx is smaller than a cumulative staying time Ty. Each of the staying time Tx and the cumulative staying time Ty indicate the time for which the liquid has stayed in the reservoir portion 121.

The control portion 60 counts the elapsed time as the staying time Tx while the liquid ejecting apparatus 10 is electrically conductive regardless of whether the power supply is turned on or off. Therefore, the value of the staying time Tx increases as time passes. The staying time Tx is reset by supplying the liquid stored in the reservoir portion 121 to the liquid ejecting portion 41.

The cumulative staying time Ty is a parameter for storing the value of the staying time Tx. When a value of the staying time Tx is stored as the cumulative staying time Ty, the control portion 60 starts to count the cumulative staying time Ty. Accordingly, the cumulative staying time Ty takes a value obtained by adding the stored staying time Tx to the time having passes since the staying time Tx was stored. The cumulative staying time Ty is reset at a predetermined timing.

In step S11, when the staying time Tx is smaller than the cumulative staying time Ty, the control portion 60 shifts the process to step S12. In step S11, when the staying time Tx is equal to or greater than the cumulative staying time Ty, the control portion 60 shifts the process to step S14.

In step S12, the control portion 60 sets the value of the cumulative staying time Ty to the staying time Tx. At this time, the staying time Tx and the cumulative staying time Ty have the same value.

In step S13, the control portion 60 resets the cumulative staying time Ty. At this time, the cumulative staying time Ty has a value of 0, and the counting of the cumulative staying time Ty is stopped.

In step S14, the control portion 60 determines whether or not the staying time Tx exceeds a first set time T1. The first set time T1 is a time when the settling of the liquid components is estimated to occur in the reservoir portion 121. Therefore, when the staying time Tx is equal to or less than the first set time T1, it is expected that the settling of the liquid components has not occurred yet in the reservoir portion 121. In the present embodiment, the first set time T1 is, for example, one month.

In step S14, when the staying time Tx exceeds the first set time T1, the control portion 60 shifts the process to step S15. In step S14, when the staying time Tx is equal to or less than the first set time T1, the control portion 60 shifts the process to step S23.

In step S23, the control portion 60 performs printing using the liquid contained in the liquid supply source 101. At this time, the control portion 60 supplies the liquid toward the liquid ejecting portion 41 from the liquid supply source 101 so that the volume of the liquid stored in the reservoir portion 121 does not change. When processing in step S23 is finished, the control portion 60 ends the printing process.

When the staying time Tx exceeds the first set time T1 in step S14, the control portion 60 determines whether or not the staying time Tx exceeds a second set time T2 in step S15. The second set time T2 is a time when the settling of the liquid components is estimated to be progressed in the reservoir portion 121. In the present embodiment, when the staying time Tx is equal to or less than the second set time T2 and exceeds the first set time T1, it is expected that the settling of the liquid components in the reservoir portion 121 is a small amount. When the staying time Tx exceeds the second set time T2, it is expected that the settling of the liquid components in the reservoir portion 121 is a large amount. In the present embodiment, the second set time T2 is, for example, six months.

In step S15, when the staying time Tx exceeds the second set time T2, that is, when it is expected that the settling of the liquid components in the reservoir portion 121 is a large amount, the control portion 60 shifts the process to step S21. In step S15, when the staying time Tx is equal to or less than the second set time T2, that is, when it is expected that the settling of the liquid components in the reservoir portion 121 is a small amount, the control portion 60 shifts the process to step S16.

In step S16, the control portion 60 performs printing using the liquid stored in the reservoir portion 121. At this time, the control portion 60 supplies the liquid toward the liquid ejecting portion 41 from the reservoir portion 121 so that the volume of the liquid stored in the reservoir portion 121 becomes small. In step S16, since the settling of the liquid components in the reservoir portion 121 is expected to be a small amount, the liquid in the reservoir portion 121 is stirred by supplying the liquid from the reservoir portion 121 toward the liquid ejecting portion 41. When the liquid in the reservoir portion 121 is sufficiently stirred, the settling of the liquid components in the reservoir portion 121 is resolved.

In step S16, the control portion 60 counts the amount of the liquid supplied to the liquid ejecting portion 41 from the reservoir portion 121. After having finished the printing, the control portion 60 supplies the liquid to the reservoir portion 121 from the liquid supply source 101. Thus, an old liquid is replaced with a new liquid in the reservoir portion 121.

In step S17, the control portion 60 determines whether or not a liquid consumption amount Wx is equal to or greater than a set consumption amount W1. The liquid consumption amount Wx indicates the amount of the liquid in the reservoir portion 121 which was consumed in the printing. That is, the liquid consumption amount Wx includes the amount of the liquid having been supplied from the reservoir portion 121 to the liquid ejecting portion 41 in step S16. The set consumption amount W1 is a liquid consumption amount which is expected to be able to resolve the settling of the liquid components, when the settling of the liquid components in the reservoir portion 121 is a small amount. In the present embodiment, the setting consumption amount W1 is, for example, five grams.

As the amount of the liquid supplied from the reservoir portion 121 to the liquid ejecting portion 41 increases, the liquid is further stirred in the reservoir portion 121. In the present embodiment, when the liquid consumption amount Wx is equal to or greater than the set consumption amount W1, it is expected that the settling of the liquid components in the reservoir portion 121 has been resolved. When the liquid consumption amount Wx is less than the set consumption amount W1, it is expected that the settling of the liquid components in the reservoir portion 121 has not been resolved.

In step S17, when the liquid consumption amount Wx is equal to or greater than the set consumption amount W1, that is, when it is expected that the settling of the liquid components in the reservoir portion 121 has been resolved, the control portion 60 shifts the process to step S18. When the liquid consumption amount Wx is less than the set consumption amount W1 in step S17, that is, when it is expected that the settling of the liquid components in the reservoir portion 121 has not been resolved, the control portion 60 shifts the process to step S20.

In step S18, the control portion 60 resets the liquid consumption amount Wx. At this time, the liquid consumption amount Wx becomes 0.

In step S19, the control portion 60 resets the staying time Tx. At this time, the value of the staying time Tx becomes 0. The counting of the staying time Tx is continued after being reset. After having completed processing in step S19, the control portion 60 ends the printing process.

When the liquid consumption amount Wx is less than the set consumption amount W1 in step S17, the control portion 60 sets the value of the staying time Tx to the cumulative staying time Ty in step S20. At this time, the staying time Tx and the cumulative staying time Ty have the same value. After the value of the staying time Tx is set, the counting of the cumulative staying time Ty is started. The control portion 60, after having completed processing in step S20, resets the staying time Tx in step S19.

When the staying time Tx exceeds the second set time T2 in step S15, the control portion 60 discharges the liquid in the reservoir portion 121 in step S21. When the staying time Tx exceeds the second set time T2, the control portion 60 discharges the liquid in the reservoir portion 121 because the settling of the liquid components in the reservoir portion 121 has progressed. In the present embodiment, the control portion 60 performs suction cleaning in step S21. The control portion 60, after having discharged the liquid in the reservoir portion 121, supplies a liquid to the reservoir portion 121 from the liquid supply source 101. Thus, the old liquid is replaced with a new liquid in the reservoir portion 121.

In step S22, the control portion 60 resets the liquid consumption amount Wx and the staying time Tx. At this time, the values of the liquid consumption amount Wx and the staying time Tx become 0. The counting of the staying time Tx is continued after being reset.

The control portion 60, after having completed processing in step S22, performs printing using the liquid in the liquid supply source 101 in step S23. After having completed processing in step S23, the control portion 60 ends the printing process.

By storing the staying time Tx as the cumulative staying time Ty in the current printing process, it is possible to determine whether or not the settling of the liquid components in the reservoir portion 121 will be resolved in the next printing process. When the value of the staying time Tx is set to the cumulative staying time Ty in step S20 of the current printing process, the staying time Tx becomes equal to or less than the cumulative staying time Ty in step S11 of the next printing process. Accordingly, in this case, in step S12 of the next printing process, the value of the cumulative staying time Ty is set to the staying time Tx. In this manner, the staying time Tx in the current printing process is handed over to the next printing process.

In the printing process, when the processing in step S20 is selected and carried out, the liquid consumption amount Wx is not reset. Therefore, when the liquid consumption amount Wx is less than the set consumption amount W1 in the current printing process, the liquid consumption amount Wx in the current printing process is handed over to the next printing process.

In the next printing process, operations are performed based on the value of the handed-over staying time Tx and the value of the handed-over liquid consumption amount Wx. In the next printing process, when a time obtained by adding the handed-over staying time Tx to the time counted after being handed over is less than the second set time T2 and an amount obtained by adding the handed-over liquid consumption amount Wx to the amount of liquid consumption after being handed over is equal to or greater than the set consumption amount W1, it is expected that the settling of the liquid components in the reservoir portion 121 will be resolved. That is, when a liquid in an amount equal to or greater than the set consumption amount W1 is supplied from the reservoir portion 121 toward the liquid ejecting portion 41 before the time having passed since the reservoir portion 121 stored the liquid exceeds the second set time T2, the settling of the liquid components in the reservoir portion 121 will be resolved.

Next, operations and effects of the above embodiment will be described.

1. The outflow opening 126 and the inflow opening 128 are located at different positions in the width direction which is a lengthwise direction of the reservoir portion 121 when the reservoir portion 121 is viewed from the first end 121A, and also located at different positions in the depth direction from the first end 121A toward the second end 121B on the opposite side to the first end 121A. In the liquid reservoir unit 120, the liquid flows into the reservoir portion 121 through the inflow opening 128 of the inflow portion 125. The liquid flows out of the reservoir portion 121 through the outflow opening 126 of the outflow portion 124. Therefore, in the reservoir portion 121, the liquid flows from the inflow opening 128 toward the outflow opening 126; note that the inflow opening 128 and the outflow opening 126 are located at the different positions in the width direction and the depth direction. At this time, the liquid is stirred in the reservoir portion 121. This makes it possible to suppress the settling of the liquid components.

2. The inflow opening 128 is opened facing the second end 121B. With this, the liquid flowing into the reservoir portion 121 flows from the inflow opening 128 toward the inner wall near the second end 121B. As a result, the liquid is effectively stirred in the reservoir portion 121.

3. The outflow opening 126 is opened to a position closer to the first end 121A than to the second end 121B, and the inflow opening 128 is opened to a position closer to the second end 121B than to the first end 121A. With this, since the length of the outflow portion 124 in the depth direction can be shortened, the amount of the liquid staying in the outflow portion 124 can be reduced. As a result, the amount of the liquid in which the components have settled can be reduced in the outflow portion 124.

4. The reservoir portion 121 is constituted of the bag-like member 122 having flexibility. By doing so, it is possible to cause the liquid to flow inside the reservoir portion 121 by deforming the reservoir portion 121 constituted of the bag-like member 122. This makes it possible to suppress the settling of the liquid components.

5. The liquid ejecting apparatus 10 includes the control portion 60 configured to control the discharge mechanism 50 to discharge the liquid staying in the reservoir portion 121 as a waste liquid when a stay of the liquid in the reservoir portion 121 exceeds the set time. According to the liquid ejecting apparatus 10, the liquid whose components are expected to have settled in the reservoir portion 121 can be discharged as a waste liquid. Thus, for example, it is possible to reduce a risk of printing an image on the medium M by using the liquid in which the components have settled.

6. The outflow portion 124 is coupled to part of the liquid supply flow path 110 closer to the liquid ejecting portion 41, and the inflow portion 125 is coupled to part of the liquid supply flow path 110 closer to the liquid supply source 101. In this case, the liquid flows from the liquid supply source 101 toward the liquid ejecting portion 41, whereby the liquid stored in the reservoir portion 121 is stirred. This makes it possible to suppress the settling of the liquid components.

7. The holding portion 152 holds the liquid reservoir portion 121 in such a manner that the height direction, which is a short-length direction of the reservoir portion 121 when the reservoir portion 121 is viewed from the first end 121A, is taken as a vertical direction. This makes it possible for the holding portion 152 to hold the liquid reservoir unit 120 in a horizontally placed state.

The present embodiment may be modified and implemented as follows. The present embodiment and the following modifications may be implemented in combination with each other within a range where no technical contradiction exists.

Figure 10:
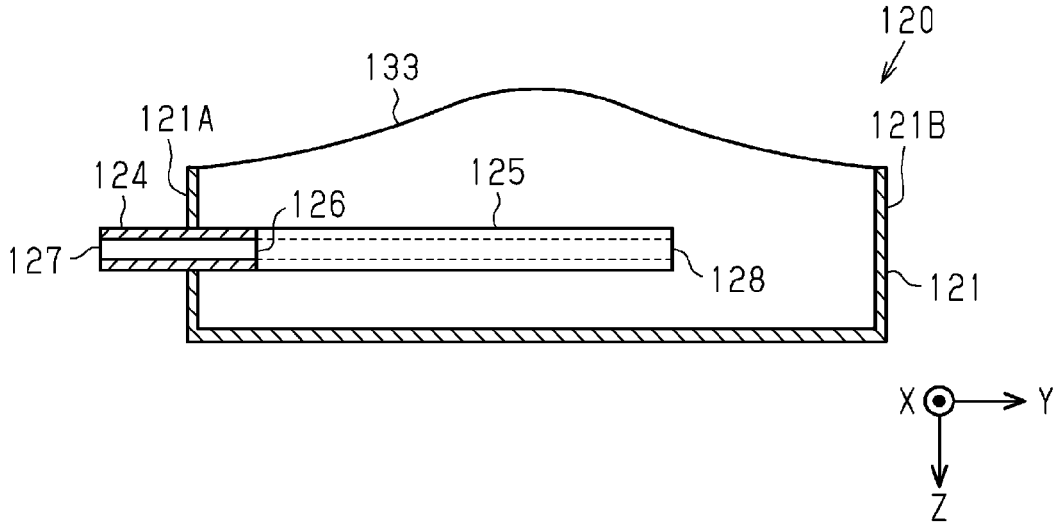
FIG. 10 is a schematic diagram illustrating a modification of a liquid reservoir unit.

As illustrated in FIG. 10, the liquid reservoir unit 120 may be configured such that part of the wall of the reservoir portion 121 is formed of a flexible member 133. In this case, for example, the pressure mechanism 150 depressurizes or pressurizes a space around the reservoir portion 121, thereby displacing the flexible member 133. Thus, the amount of liquid stored in the reservoir portion 121 may be controlled. Further, as illustrated in FIG. 10, the holding portion 152 may hold the liquid reservoir unit 120 in a posture in which the flexible member 133 forms an upper wall of the liquid reservoir unit 120, or may hold the liquid reservoir unit 120 in a posture in which the flexible member 133 forms a lower wall of the liquid reservoir unit 120.

Figure 11:
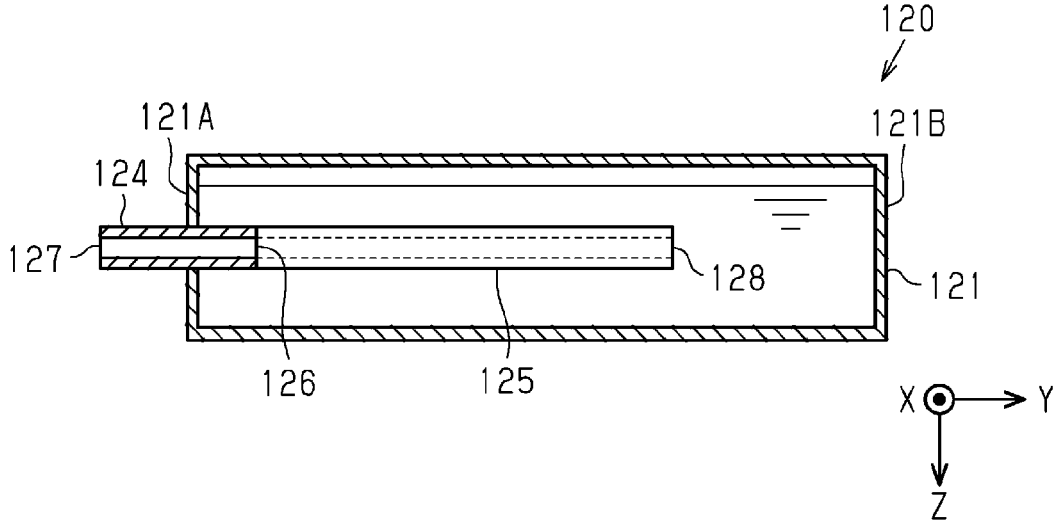
FIG. 11 is a schematic diagram illustrating another modification of a liquid reservoir unit.

As illustrated in FIG. 11, the reservoir portion 121 may be configured as a rigid case, for example. A region where a liquid is present and a region where a gas is present appear in the reservoir portion 121. In this case, for example, the pressure mechanism 150 depressurizes or pressurizes the upper space where the gas is present in the reservoir portion 121, thereby making it possible to control the amount of liquid stored in the reservoir portion 121.

The outflow opening 126 may be located closer to an edge of the reservoir portion 121 in the width direction of the reservoir portion 121. For example, the outflow opening 126 may be provided at a position where a distance between the outflow opening 126 and the bonding portion 130 is smaller than a distance between the outflow opening 126 and the inflow opening 128 in the width direction of the reservoir portion 121.

The inflow opening 128 may be located closer to the edge of the reservoir portion 121 in the width direction of the reservoir portion 121. For example, the inflow opening 128 may be provided at a position where a distance between the inflow opening 128 and the bonding portion 130 is smaller than the distance between the inflow opening 128 and the outflow opening 126 in the width direction of the reservoir portion 121.

The inflow opening 128 may be opened on a circumferential surface of the tubular inflow portion 125. A plurality of inflow openings 128 may be opened on the inflow portion 125.

The outflow portion 124 and the inflow portion 125 may be constituted of, for example, a flexible tube.

The liquid reservoir unit 120 may be configured to allow a gas to flow thereinto through the inflow portion 125. In this case, the liquid reservoir unit 120 may be used as the liquid supply source 101.

The liquid ejecting apparatus 10 may be configured to perform choke cleaning in a state in which the pressure chamber 151 is opened to the atmosphere. When the choke cleaning is performed in a state in which the pressure chamber 151 is opened to the atmosphere, bubbles, foreign objects, and the like in the reservoir portion 121 may be discharged.

Not only during the maintenance but also during the liquid ejecting apparatus 10 performing printing, the pressure mechanism 150 may apply a negative pressure to the interior of the reservoir portion 121 when the liquid ejecting apparatus 10 is in a standby mode or the like. For example, the pressure mechanism 150 may apply a negative pressure to the interior of the reservoir portion 121 so that the amount of the liquid stored in the reservoir portion 121 is maintained at a level of a predetermined amount or more than a predetermined amount. That is, the pressure mechanism 150 may depressurize the interior of the pressure chamber 151 so that the bag-like member 122 is maintained to be in contact with the inner wall 154 of the holding portion 152. This makes it possible to supply the liquid from the liquid supply source 101 toward the liquid ejecting portion 41 while maintaining the amount of the liquid stored in the reservoir portion 121 at the level of the predetermined amount or more than the predetermined amount.

The liquid reservoir unit 120 may be mounted in the carriage 43.

The medium M may be a metal film, a plastic film, a cloth, or the like.

The liquid ejected by the liquid ejecting portion 41 is not limited to ink, and may be, for example, a liquid material obtained by dispersing or mixing particles of a functional material in a liquid. For example, the liquid ejecting portion 41 may eject a liquid material containing a material such as an electrode material or a pixel material used for the manufacture of liquid crystal displays, electroluminescence displays, surface-emitting displays, and the like in the form of dispersion or dissolution.

Technical ideas and operational advantages understood from the above embodiment and modifications will be described below.

A liquid reservoir unit includes a reservoir portion configured to store a liquid; an outflow portion disposed at a position near a first end of the reservoir portion and configured to cause the liquid to flow out of the reservoir portion; and an inflow portion disposed at a position near the first end of the reservoir portion and configured to cause the liquid to flow into the reservoir portion. The outflow portion includes an outflow opening opened to an interior of the reservoir portion, and the inflow portion includes an inflow opening opened to the interior of the reservoir portion. The outflow opening and the inflow opening are located at different positions in a width direction which is a lengthwise direction of the reservoir portion when the reservoir portion is viewed from the first end, and also located at different positions in a depth direction from the first end toward a second end on the opposite side to the first end.

According to this configuration, the liquid flows into the reservoir portion through the inflow opening of the inflow portion. The liquid flows out of the reservoir portion through the outflow opening of the outflow portion. Therefore, in the reservoir portion, the liquid flows from the inflow opening toward the outflow opening; the inflow opening and the outflow opening are located at different positions in the width direction and the depth direction. At this time, the liquid is stirred in the reservoir portion. This makes it possible to suppress the settling of the liquid components.

The inflow opening may be opened facing the second end in the liquid reservoir unit.

With this configuration, the liquid flowing into the reservoir portion flows from the inflow opening toward the inner wall near the second end. As a result, the liquid is effectively stirred in the reservoir portion.

In the liquid reservoir unit, the outflow opening may be opened to a position closer to the first end than to the second end, and the inflow opening may be opened to a position closer to the second end than to the first end.

With this configuration, since the length of the outflow portion in the depth direction can be shortened, the amount of the liquid staying in the outflow portion can be reduced. As a result, the amount of the liquid in which the components have settled may be reduced in the outflow portion.

In the liquid reservoir unit, the reservoir portion may be constituted of a flexible bag-like member.

According to this constitution, it is possible to cause the liquid to flow inside the reservoir portion by deforming the reservoir portion constituted of the bag-like member. This makes it possible to suppress the settling of the liquid components.

A liquid ejecting apparatus includes a liquid ejecting portion configured to eject a liquid through a nozzle; a liquid supply flow path configured to supply the liquid contained in a liquid supply source to the liquid ejecting portion; a liquid reservoir unit having a reservoir portion that is provided in the liquid supply flow path and is configure to store the liquid; a discharge mechanism configured to discharge the liquid in the liquid supply flow path from a side of the liquid ejecting portion relative to the reservoir portion in the liquid supply flow path by depressurizing the liquid supply flow path; and a control portion configured to control the discharge mechanism to discharge the liquid staying in the reservoir portion as a waste liquid when a stay of the liquid in the reservoir portion exceeds a set time.

According to this configuration, the liquid whose components are expected to have settled in the reservoir portion can be discharged as a waste liquid. Thus, for example, it is possible to reduce a risk of printing an image on a medium by using the liquid in which the components have settled.

In the liquid ejecting apparatus, the liquid reservoir unit may include a bag-like member constituting the reservoir portion, an outflow portion disposed at a position near a first end of the reservoir portion and configured to cause the liquid to flow out of the reservoir portion, and an inflow portion disposed at a position near the first end and configured to cause the liquid to flow into the reservoir portion; the outflow portion may be coupled to part of the liquid supply flow path closer to the liquid ejecting portion, and the inflow portion may be coupled to part of the liquid supply flow path closer to the liquid supply source.

With this configuration, the liquid flows from the liquid supply source toward the liquid ejecting portion, whereby the liquid stored in the reservoir portion is stirred. This makes it possible to suppress the settling of the liquid components.

The liquid ejecting apparatus may include a holding portion for holding the liquid reservoir unit, the outflow portion may have an outflow opening opened to the interior of the reservoir portion, the inflow portion may have an inflow opening opened to the interior of the reservoir portion, the outflow opening and the inflow opening may be located at different positions in the width direction which is a lengthwise direction of the reservoir portion when the reservoir portion is viewed from the first end, and the holding portion may hold the reservoir portion in such a manner that the height direction, which is a short-length direction of the reservoir portion when the reservoir portion is viewed from the first end, is taken as a vertical direction.

This configuration makes it possible for the holding portion to hold the liquid reservoir unit in a horizontally placed state.

In the liquid ejecting apparatus, the outflow opening and the inflow opening may be located at different positions in the depth direction from the first end toward a second end on the opposite side to the first end.

With this configuration, when the liquid flows from the liquid supply source toward the liquid ejecting portion, the liquid stored in the reservoir portion is effectively stirred. This makes it possible to suppress the settling of the liquid components.

In the liquid ejecting apparatus, the inflow opening may be opened facing the second end on the opposite side to the first end.

With this configuration, when the liquid flows into the reservoir portion, it flows from the inflow opening toward the inner wall near the second end. As a result, the liquid is effectively stirred inside the reservoir portion.

In the liquid ejecting apparatus, the outflow opening may be opened to a position closer to the first end than to the second end on the opposite side to the first end, and the inflow opening may be opened to a position closer to the second end than to the first end.

With this configuration, since the length of the outflow portion in the depth direction can be shortened, the amount of the liquid staying inside the outflow portion can be reduced. As a result, the amount of the liquid in which the components have settled may be reduced inside the outflow portion.

A maintenance method for a liquid ejecting apparatus is a maintenance method for the liquid ejecting apparatus that includes a liquid ejecting portion configured to eject a liquid through a nozzle; a liquid supply flow path configured to supply the liquid contained in a liquid supply source to the liquid ejecting portion; and a liquid reservoir unit having a reservoir portion provided in the liquid supply flow path and configured to store the liquid. The method includes discharging the liquid staying in the reservoir portion as a waste liquid when a stay of the liquid in the reservoir portion exceeds a set time.

According to this method, the liquid whose components are expected to have settled in the reservoir portion can be discharged as a waste liquid. Thus, for example, it is possible to reduce a risk of printing an image on a medium by using the liquid in which the components have settled.

Second Embodiment

Next, a second embodiment of a liquid ejecting apparatus and a control method for a liquid ejecting apparatus will be described with reference to the accompanying drawings. The second embodiment is different from the first embodiment in the configuration of a liquid supply source and the control of a liquid ejecting apparatus. Since other points are substantially the same as those of the first embodiment, the same reference numerals are given to the same constituent elements so as to omit redundant description thereof.

Figure 12:
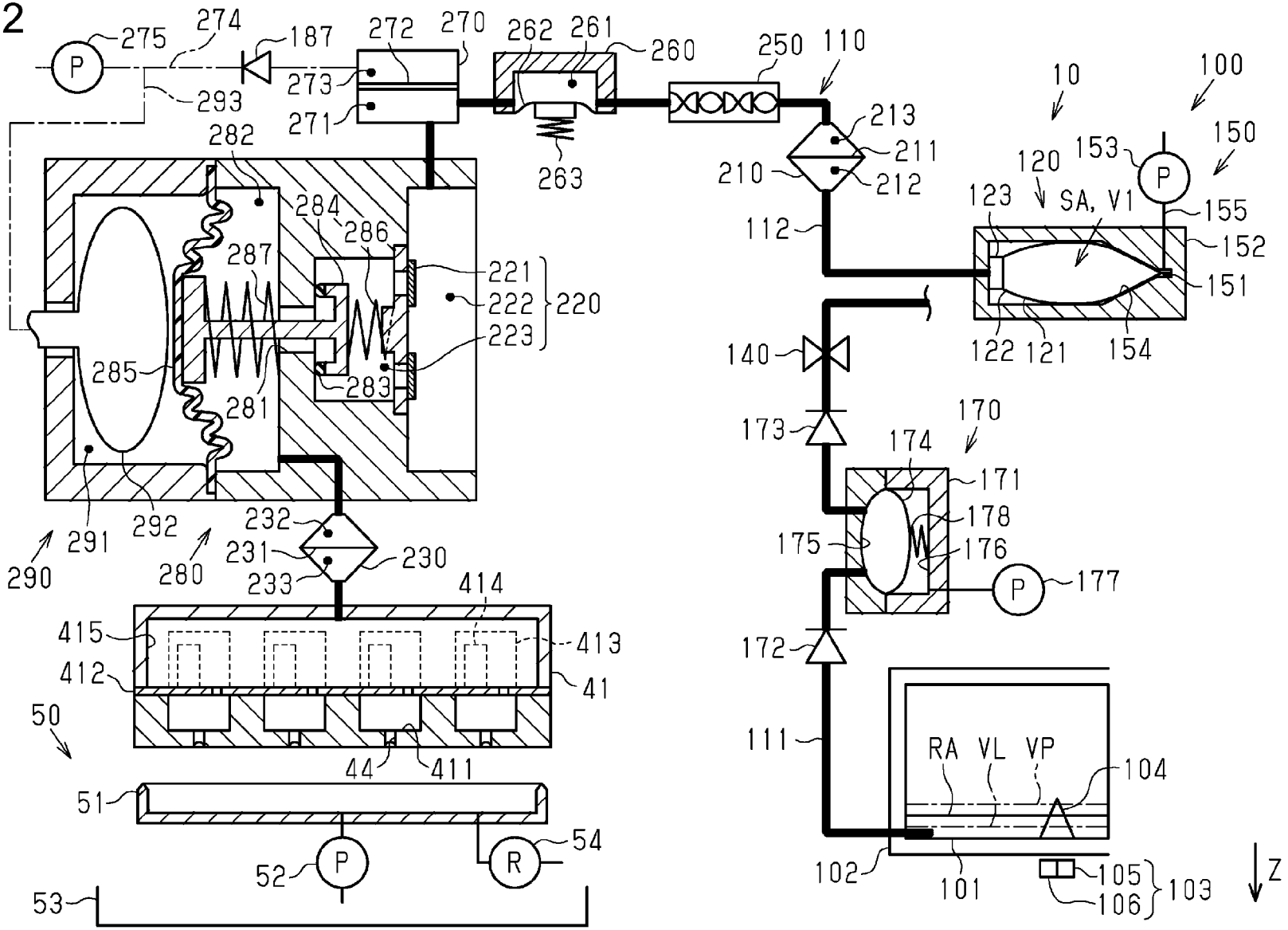
FIG. 12 is a schematic diagram illustrating a second embodiment of a configuration of a liquid ejecting apparatus and a liquid supply device.

As illustrated in FIG. 12, a pressure mechanism 150 as a reservoir amount adjustment mechanism is configured to adjust a reservoir amount SA of a liquid stored in a reservoir portion 121. The pressure mechanism 150 may apply pressure to the interior of the reservoir portion 121 from the exterior. The pressure mechanism 150 may apply pressure to the interior of the reservoir portion 121 via the flexible member 133.

The pressure mechanism 150 of the present embodiment applies a positive pressure, by pressurizing the outside of the reservoir portion 121, to the liquid in the reservoir portion 121 to deflate a bag-like member 122 in such a manner as to decrease the volume of the reservoir portion 121. The pressure mechanism 150 inflates the bag-like member 122 in such a manner as to increase the volume of the reservoir portion 121 by depressurizing the outside of the reservoir portion 121. When the bag-like member 122 is inflated, the pressure inside the reservoir portion 121 is reduced. In this manner, the pressure mechanism 150 applies a negative pressure to the interior of the reservoir portion 121 from the outside of the reservoir portion 121. The pressure mechanism 150 may be configured to apply pressure from the exterior to the interior of the reservoir portion 121 by displacing the flexible member 133 by using a mechanical element such as a spring or a lever.

The pressure mechanism 150 may include a holding portion 152 having a pressure chamber 151 for accommodating the reservoir portion 121, and a pump 153 for pressurizing or depressurizing the interior of the pressure chamber 151. The pressure mechanism 150 pressurizes the interior of the pressure chamber 151 by using the pump 153, thereby applying a positive pressure to the interior of the reservoir portion 121 from the exterior. The pressure mechanism 150 depressurizes the interior of the pressure chamber 151 by using the pump 153, thereby applying a negative pressure to the interior of the reservoir portion 121 from the exterior. When the interior of the pressure chamber 151 is pressurized, the bag-like member 122 is deflated. The deflated bag-like member 122 leaves an inner wall 154 of the holding portion 152 forming the pressure chamber 151. When the interior of the pressure chamber 151 is depressurized, the bag-like member 122 is inflated. The inflated bag-like member 122 makes contact with the inner wall 154.

The pressure mechanism 150 adjusts the pressure inside the reservoir portion 121 by changing the pressure inside the pressure chamber 151. The pressure mechanism 150 changes a volume of the interior of the bag-like member 122 by applying pressure to the outside of the bag-like member 122, thereby adjusting the reservoir amount SA. The pressure mechanism 150 may be configured to open the pressure chamber 151 to the atmosphere.

The pressure mechanism 150 may include a pressure adjustment flow path 155 coupling the pressure chamber 151 and the pump 153 located outside the holding portion 152. The pump 153 pressurizes or depressurizes the pressure chamber 151 through the pressure adjustment flow path 155. The pump 153 may be located inside the holding portion 152.

Next, a liquid supply device 100 of the present embodiment will be described.

The liquid supply device 100 includes a liquid supply source holding portion 102 configured to attach and detach a liquid supply source 101 containing a liquid. A liquid supply flow path 110 is configured to supply a liquid, to the liquid ejecting portion 41, from the liquid supply source 101 mounted on the liquid supply source holding portion 102.

It is sufficient that the liquid supply source 101 is configured to contain a liquid, and therefore the liquid supply source 101 may be, for example, a replaceable cartridge type, or a tank type able to replenish the liquid. The liquid supply source 101 is so provided as to correspond to the number of liquid types used by the liquid ejecting apparatus 10.

The liquid supply device 100 may include a remaining amount acquisition portion 103 configured to acquire a remaining amount Ra of the liquid contained in the liquid supply source 101. The remaining amount acquisition portion 103 may detect the liquid contained in the liquid supply source 101 by using an optical sensor. The remaining amount acquisition portion 103 of the present embodiment includes a light emitting portion 105 configured to emit light toward a prism 104 included in the liquid supply source 101, and a light receiving portion 106 configured to receive light that returns from the prism 104. The prism 104 is, for example, a triangular prism. The traveling direction of the light incident on the prism 104 is changed in accordance with the amount of liquid contained in the liquid supply source 101.

Specifically, when the liquid is sufficiently contained in the liquid supply source 101, a contact area between the prism 104 and the liquid is large. As such, the light incident on the prism 104 travels in the liquid in such a manner as to pass through the prism 104, and only a small amount of light returns to the light receiving portion 106. When the amount of liquid contained in the liquid supply source 101 becomes small and the prism 104 is exposed from the liquid, the contact area between the prism 104 and the liquid is small. Because of this, the light incident on the prism 104 is reflected in such a manner as to travel in the prism 104 and then arrives at the light receiving portion 106. Therefore, the amount of light received by the light receiving portion 106 when the prism 104 is exposed from the liquid, is larger than that of when the prism 104 is hidden in the liquid.

The remaining amount acquisition portion 103 outputs the amount of light received by the light receiving portion 106 to the control portion 60. The control portion 60 determines whether or not the remaining amount Ra of the liquid contained in the liquid supply source 101 is equal to or less than a predetermined value VP, or equal to or less than a limit value VL based on the amount of light received by the light receiving portion 106.

Next, a reservoir unit 120 according to the second embodiment will be described.

Figure 13:
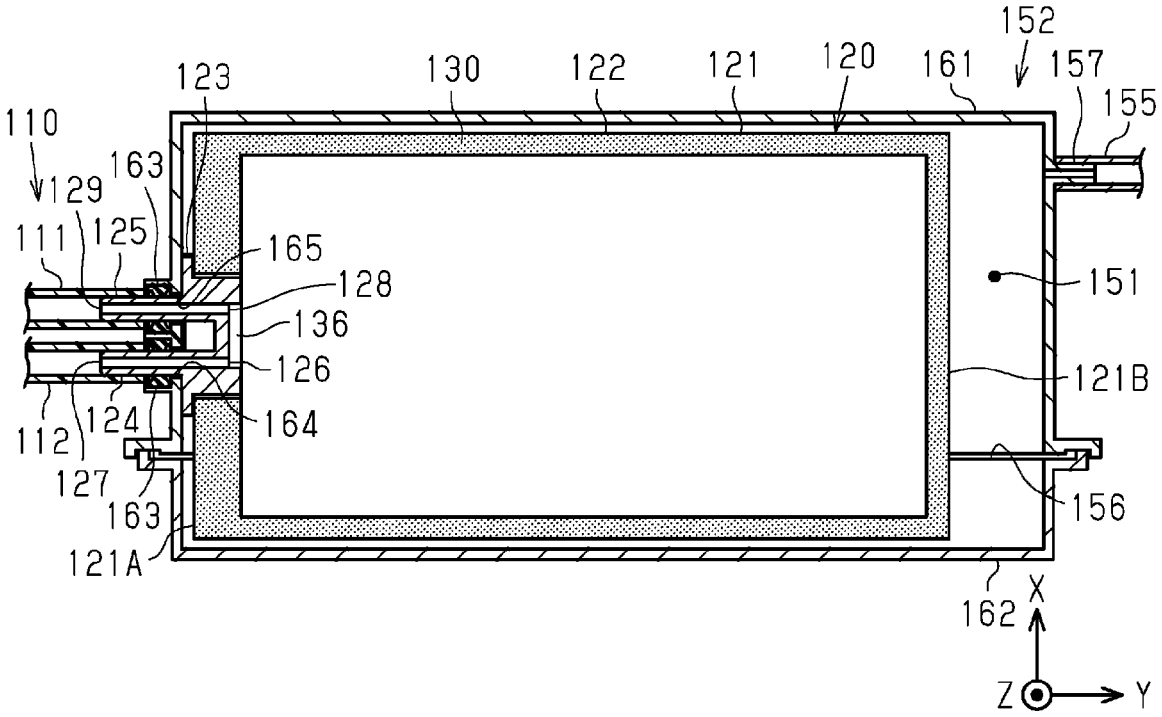
FIG. 13 is a cross-sectional view of a liquid reservoir unit of the second embodiment taken along the line XIII-XIII in FIG. 5.

As illustrated in FIG. 13, the reservoir unit 120 may include an outflow portion 124 for leading a liquid out of the reservoir unit 120, and an inflow portion 125 for introducing a liquid into the reservoir unit 120. The outflow portion 124 and the inflow portion 125 of the present embodiment are provided in a connection body 123, and have openings in the bag-like member 122. The liquid introduced from the inflow portion 125 is led out from the outflow portion 124 through the interior of the reservoir unit 120.

The connection body 123 may have a coupling path 136 for coupling the inflow portion 125 and the outflow portion 124. With this, even when the bag-like member 122 is completely deflated, the liquid may be allowed to flow from the inflow portion 125 to the outflow portion 124 through the coupling path 136.

Next, an upper limit value of the reservoir amount SA of the liquid stored in the reservoir portion 121, and the predetermined value VP and the limit value VL of the remaining amount Ra of the liquid contained in the liquid supply source 101 will be described.

As illustrated in FIG. 12 and FIG. 13, the reservoir portion 121 stores a liquid in the bag-like member 122 having a variable shape. Therefore, the reservoir amount SA, which is the amount of the liquid stored in the reservoir portion 121, varies depending on the shape of the bag-like member 122.

As illustrated in FIG. 12, for example, the pressure mechanism 150 depressurizes the interior of the pressure chamber 151 to cause the pressure outside the bag-like member 122 to be lower than the pressure inside the bag-like member 122, thereby inflating the bag-like member 122. When the bag-like member 122 is inflated up to the maximum, the outer surface of the bag-like member 122 is brought into contact with the inner wall 154. The reservoir amount SA of the reservoir portion 121 in this state is at its maximum. In this embodiment, the maximum amount of liquid that can be stored in the reservoir portion 121 is defined as a first upper limit value V1.

Figure 14:
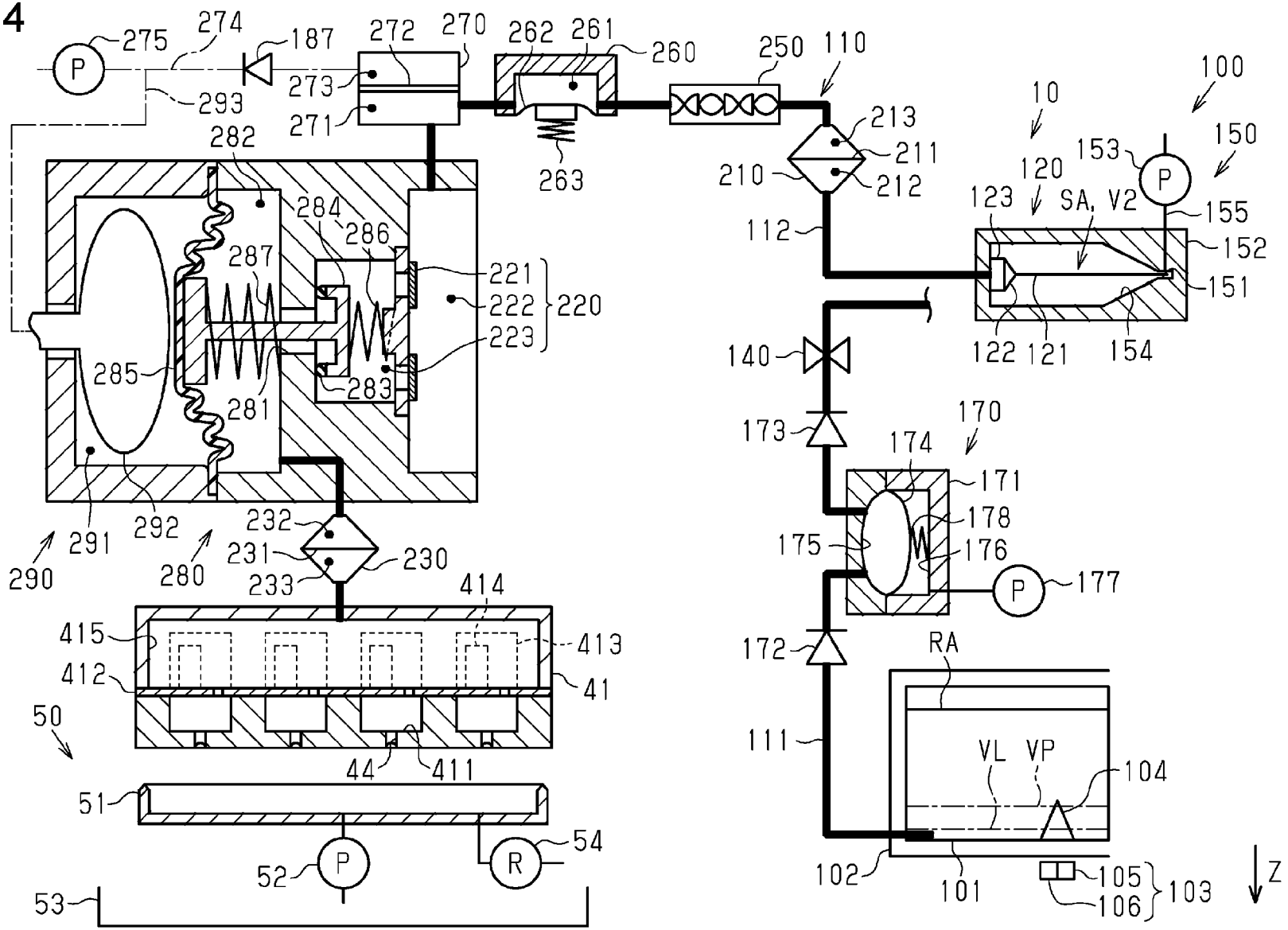
FIG. 14 is a schematic diagram of a liquid ejecting apparatus when a remaining amount is larger than a predetermined amount.

As illustrated in FIG. 14, for example, the pressure mechanism 150 pressurizes the interior of the pressure chamber 151 to cause the pressure outside the bag-like member 122 to be higher than the pressure inside the bag-like member 122, thereby deflating the bag-like member 122. When the bag-like member 122 is deflated, the opposing inner surfaces of the bag-like member 122 are brought into contact with each other. The reservoir amount SA in this state is defined as a second upper limit value V2. When the bag-like member 122 is completely deflated, a contact area between the inner surfaces of the bag-like member 122 becomes maximum, and the reservoir amount SA becomes minimum. The second upper limit value V2 may be the same as the minimum reservoir amount SA, or may be larger than the minimum reservoir amount SA and smaller than the first upper limit value V1.

As illustrated in FIG. 14, the predetermined value VP may be the same as the first upper limit value V1, or may be a value larger than the first upper limit value V1. The limit value VL is a value smaller than the predetermined value VP, and is, for example, 0 or significantly small. When the remaining amount Ra becomes equal to the limit value VL, the liquid cannot be supplied to a liquid ejecting portion 41 from the liquid supply source 101. Accordingly, the limit value VL is an amount of liquid indicating that the liquid supply source 101 is required to be replaced.

Next, a control method for the liquid ejecting apparatus 10 will be described with reference to a flowchart illustrated in FIG. 15.

Figure 15:
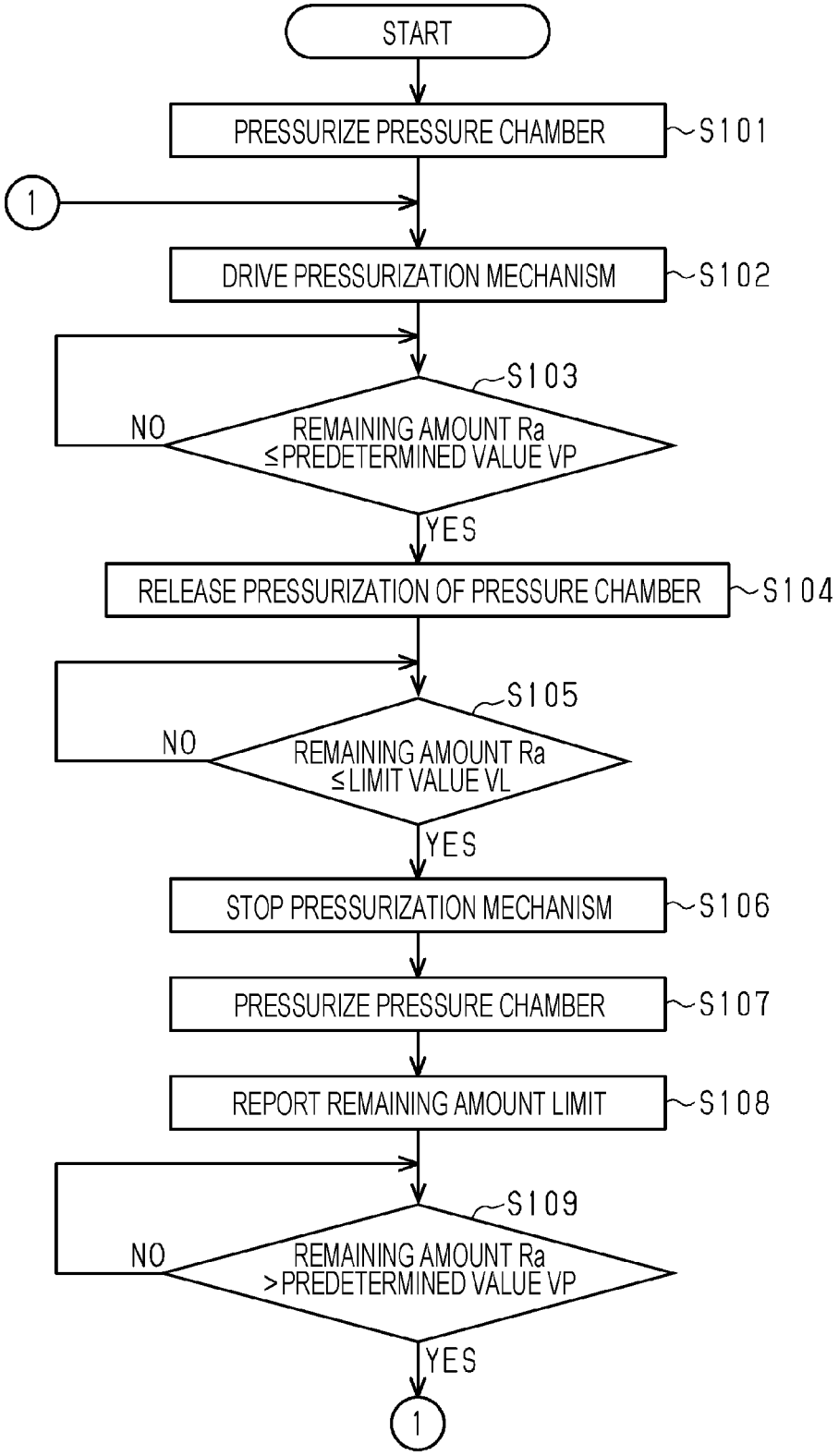
FIG. 15 is a flowchart illustrating a liquid supply routine.

As illustrated in FIG. 15, in step S101, the control portion 60 drives the pump 153 for pressurization to pressurize the pressure chamber 151. In step S102, the control portion 60 drives a pressurization mechanism 170. In step S103, the control portion 60 determines whether or not the remaining amount Ra of the liquid contained in the liquid supply source 101 is equal to or smaller than the predetermined value VP.

When the remaining amount Ra is greater than the predetermined value VP, step S103 indicates "NO". The control portion 60 waits until the remaining amount Ra becomes equal to or smaller than the predetermined value VP in a state in which the pressure chamber 151 is pressurized. When the remaining amount Ra becomes equal to or smaller than the predetermined value VP, step S103 indicates "YES". In step S104, the control portion 60 makes the pressure chamber 151 open to the atmosphere, and releases the pressurized state of the pressure chamber 151. At this time, the control portion 60 continuously drives the pressurization mechanism 170.

In step S105, the control portion 60 determines whether or not the remaining amount Ra is equal to or smaller than the limit value VL. When the remaining amount Ra is greater than the limit value VL, step S105 indicates "NO". The control portion 60 continues the driving of the pressurization mechanism 170, and waits until the remaining amount Ra becomes equal to or smaller than the limit value VL. When the remaining amount Ra becomes equal to or smaller than the limit value VL, step S105 indicates "YES". The control portion 60 shifts the process to step S106.

In step S106, the control portion 60 stops the driving of the pressurization mechanism 170. In step S107, the control portion 60 pressurizes the pressure chamber 151 by driving the pump 153 for pressurization. In step S108, the control portion 60 displays information on the operation panel 17, for example, for prompting the replacement of the liquid supply source 101, and reports that the remaining amount Ra has become equal to the limit value VL.

In step S109, the control portion 60 determines whether or not the remaining amount Ra is greater than the predetermined value VP. When the remaining amount Ra is equal to or smaller than the predetermined value VP, step S109 indicates "NO", and the control portion 60 waits. When the liquid supply source 101 is replaced and the remaining amount Ra becomes larger than the predetermined value VP, step S109 indicates YES. The control portion 60 shifts the process to step S102. The control portion 60 repeatedly performs the above-described liquid supply routine while the power supply of the liquid ejecting apparatus 10 is turned on.

Operations of the present embodiment will be described.

As illustrated in FIG. 14, the control portion 60 controls the pressure mechanism 150 to cause the reservoir amount SA, when the remaining amount Ra is greater than the predetermined value VP, to be smaller than the first upper limit value V1. When the remaining amount Ra is greater than the predetermined value VP, the control portion 60 of the present embodiment controls the pressure mechanism 150 to cause the reservoir amount SA to be equal to or smaller than the second upper limit value V2, which is smaller than the first upper limit value V1.

Specifically, when the remaining amount Ra is greater than the predetermined value VP, the control portion 60 drives the pump 153 for pressurization to make the pressure in the pressure chamber 151 higher than the pressure of the liquid inside the reservoir portion 121 pressurized by the pressurization mechanism 170. That is, in the reservoir portion 121, when the remaining amount Ra is greater than the predetermined value VP, the opposing inner surfaces of the bag-like member 122 are in contact with each other. Even when the pressurization mechanism 170 is driven to supply the liquid, the reservoir portion 121 is maintained in the deflated state, and the reservoir amount SA becomes equal to or smaller than the second upper limit value V2.

As illustrated in FIG. 6, the liquid is supplied to the liquid ejecting portion 41 through the first liquid flow path 111, the inflow portion 125, the outflow portion 124, and the second liquid flow path 112. When the liquid is consumed in the liquid ejecting portion 41, the remaining amount Ra of the liquid supply source 101 is reduced by the amount of the consumed liquid.

As illustrated in FIG. 12, the control portion 60 takes the upper limit value of the reservoir amount SA as the first upper limit value V1 when the remaining amount Ra of the liquid contained in the liquid supply source 101 is equal to or smaller than the predetermined value VP. When the remaining amount Ra is equal to or smaller than the predetermined value VP, the control portion 60 controls the pressure mechanism 150 to cause the reservoir amount SA to become equal to or smaller than the first upper limit value V1. The control portion 60 controls the pressure mechanism 150 in such a manner that, when the remaining amount Ra is equal to or smaller than the predetermined value VP, a lower pressure is applied to the outside of the bag-like member 122 than the pressure applied when the remaining amount Ra is greater than the predetermined value VP. Specifically, when the remaining amount Ra becomes equal to the predetermined value VP, the control portion 60 releases the pressurization of the interior of the pressure chamber 151.

The release of the pressurization may be carried out by driving the pump 153 for depressurization, or by opening the pressure chamber 151 to the atmosphere. When the pressurization is released, the bag-like member 122 is inflated due to the pressure by which the pressurization mechanism 170 supplies the liquid from the liquid supply source 101, whereby the volume of the reservoir portion 121 is increased.

When the predetermined value VP is equal to or greater than the first upper limit value V1, the bag-like member 122 is inflated until it comes into contact with the inner wall 154 of the holding portion 152, and the liquid of the first upper limit value V1 is stored in the reservoir portion 121. Accordingly, the control portion 60 controls the pressure mechanism 150 to adjust the reservoir amount SA so that the reservoir amount SA becomes equal to the first upper limit value V1 when the remaining amount Ra becomes equal to the predetermined value VP.

When a difference between the predetermined value VP and the limit value VL is greater than a difference between the first upper limit value V1 and the second upper limit value V2, the remaining amount Ra after the remaining amount Ra becomes equal to the predetermined value VP and the liquid is supplied to the reservoir portion 121, is greater than the limit value VL. Because of this, the control portion 60 acts to supply the liquid from the liquid supply source 101 until the remaining amount Ra becomes equal to the limit value VL. Accordingly, the reservoir amount SA is maintained at the first upper limit value V1, and the reservoir amount SA is reduced.

When the remaining amount Ra becomes equal to the limit value VL, the control portion 60 stops the driving of the pressurization mechanism 170 and pressurizes the outside of the bag-like member 122. To be specific, the control portion 60 drives the pump 153 for pressurization to pressurize the liquid in the reservoir portion 121 from the outside of the bag-like member 122. When the liquid has been consumed in the liquid ejecting portion 41, the liquid is supplied from the reservoir portion 121 to the liquid ejecting portion 41 by the amount of the liquid having been consumed. The bag-like member 122 is deflated by the amount of the liquid having been supplied, so that the volume of the reservoir portion 121 is reduced.

For example, the first upper limit value V1 may be an amount of liquid that is expected to be used for printing one image. With this, even when the liquid in the liquid supply source 101 is exhausted during the printing of an image, the printing of the image may be continued by using the liquid stored in the reservoir portion 121. This reduces a risk of the interruption of printing. Further, it is possible to suppress deterioration in print quality such as color unevenness due to the interruption of printing.

When the liquid supply source 101 is replaced and the remaining amount Ra becomes larger than the predetermined value VP, the control portion 60 drives the pressurization mechanism 170. The pressure at which the pressurization mechanism 170 pressurizes the liquid and delivers it to the reservoir portion 121 is smaller than the pressure at which the pressure mechanism 150 pressurizes the bag-like member 122. Therefore, when the reservoir amount SA is greater than the second upper limit value V2, the liquid stored in the reservoir portion 121 is supplied first to the liquid ejecting portion 41. The reservoir portion 121 is deflated until the opposing inner surfaces of the bag-like member 122 are brought into contact with each other, and the reservoir amount SA becomes equal to or smaller than the second upper limit value V2. When the reservoir amount SA becomes equal to or smaller than the second upper limit value V2, the liquid contained in the liquid supply source 101 is supplied to the liquid ejecting portion 41.

Effects of the second embodiment will be described below.

8. For example, when the liquid of the first upper limit value V1 is stored in the reservoir portion 121 regardless of the remaining amount Ra, a period of time for which the liquid stays in the reservoir portion 121 becomes long so that the settling components are likely to settle. In this regard, when the remaining amount Ra of the liquid contained in the liquid supply source 101 is greater than the predetermined value VP, the control portion 60 causes the reservoir amount SA to be smaller than the first upper limit value V1. As a result, while the remaining amount Ra is greater than the predetermined value VP, the reservoir amount SA becomes small so that the period of time for which the liquid stays in the reservoir portion 121 can be shortened. Accordingly, it is possible to reduce the risk of the progress of the settling of the settling components, and to reduce the risk that the liquid in which the settling of the settling components has progressed is supplied to the liquid ejecting portion 41.

9. When the remaining amount Ra becomes equal to the predetermined value VP, the control portion 60 controls the pressure mechanism 150 to cause the reservoir amount SA to become equal to the first upper limit value V1. Accordingly, even when the liquid is unable to be supplied from the liquid supply source 101 to the reservoir portion 121 like in a case where the liquid supply source 101 is detached from the liquid supply source holding portion 102 to be replaced, for example, the liquid stored in the reservoir portion 121 can be supplied to the liquid ejecting portion 41.

10. The reservoir portion 121 includes the bag-like member 122 formed of the flexible member 133. The bag-like member 122 having flexibility is deformed by pressure applied to the outside of the bag-like member 122, so that the volume of the interior of the bag-like member 122 is changed. Accordingly, the configuration in which the pressure mechanism 150 applies the pressure to the outside of the bag-like member 122 may be suitably employed as a configuration for adjusting the reservoir amount SA.

11. The volume of the interior of the bag-like member 122 becomes larger as the pressure applied to the outside of the bag-like member 122 is lower. In this respect, when the remaining amount Ra is equal to or smaller than the predetermined value VP, a lower pressure is applied to the outside of the bag-like member 122 than the pressure applied when the remaining amount Ra is greater than the predetermined value VP, thereby making it possible to increase the volume of the interior of the bag-like member 122. Therefore, it is possible to suitably employ the above mechanism as a mechanism for changing the volume of the interior of the bag-like member 122.

12. When the remaining amount Ra is greater than the predetermined value VP, the opposing inner surfaces among the inner surfaces included in the bag-like member 122 make contact with each other. With this, the volume of the interior of the bag-like member 122 becomes small, so that the reservoir amount SA of the liquid stored in the bag-like member 122 becomes significantly small. This makes it possible to shorten the period of time for which the liquid stays in the reservoir portion 121, and reduce the risk that the liquid in which the settling of the settling components has progressed is supplied to the liquid ejecting portion 41.

Third Embodiment

Next, a third embodiment of a liquid ejecting apparatus and a control method for a liquid ejecting apparatus will be described with reference to the accompanying drawings. The third embodiment is different from the second embodiment in the configuration of a reservoir portion. Since other points are substantially the same as those of the second embodiment, the same reference numerals are given to the same constituent elements so as to omit redundant description thereof.

Figure 16:
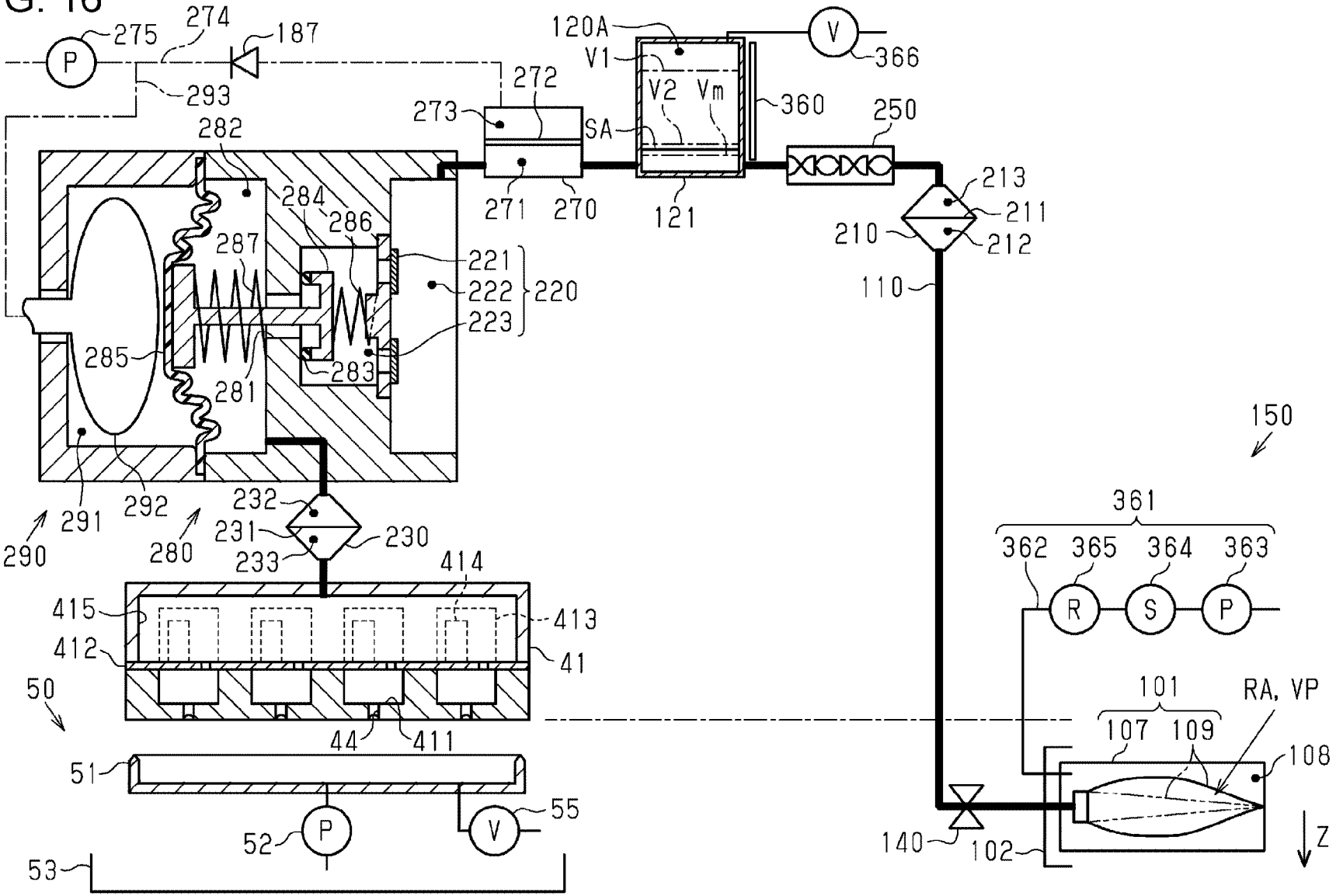
FIG. 16 is a schematic diagram illustrating a third embodiment of a liquid ejecting apparatus.

As illustrated in FIG. 16, a discharge mechanism 50 may include a first atmospheric open valve 55. When the first atmospheric open valve 55 is opened, a space enclosed by a cap 51 and a liquid ejecting portion 41 is opened to the atmosphere. The first atmospheric open valve 55 may be closed when a negative pressure is applied to a nozzle 44, and opened when the interior of the cap 51 is allowed to communicate with the atmosphere.

A liquid supply source 101 may include a case 107, and a liquid pack 109 accommodated in an air chamber 108 formed inside the case 107. The liquid pack 109 is constituted by a flexible film formed in a bag-like shape, for example.

A liquid supply source holding portion 102 may be disposed such that a position of a liquid in the liquid supply source 101 attached to the liquid supply source holding portion 102 is lower than a position at which the nozzle 44 of the liquid ejecting portion 41 opens, and also lower than a position of a liquid level when the amount of the liquid stored in a reservoir portion 121 is equal to a lower limit value Vm.

A pressure mechanism 150 includes a reservoir amount sensor 360 for detecting a reservoir amount SA of the liquid stored in the reservoir portion 121, and a supply mechanism 361 for supplying the liquid contained in the liquid supply source 101 to the reservoir portion 121. The supply mechanism 361 may include a coupling flow path 362 coupled to the liquid supply source 101 in a state of being attached to the liquid supply source holding portion 102, a pressurization pump 363 disposed in the coupling flow path 362, a pressure sensor 364, and an air pressure adjustment portion 365. The pressurization pump 363 supplies a pressurized air to the air chamber 108 through the coupling flow path 362. The pressurization pump 363 crushes the liquid pack 109 by the pressurizing force of the pressurized air supplied into the air chamber 108 to supply the liquid in the liquid pack 109 to the reservoir portion 121 through a liquid supply flow path 110.

The reservoir portion 121 may be mounted in the carriage 43 and may be provided in a movable manner together with the carriage 43. When the liquid level of the liquid stored in the reservoir portion 121 is positioned above the opening of the nozzle 44 in the liquid ejecting portion 41, a hydraulic pressure adjustment mechanism 280 may be provided between the reservoir portion 121 and the liquid ejecting portion 41 in the liquid supply flow path 110.

The reservoir portion 121 of the present embodiment is provided between a static mixer 250 and a degassing mechanism 270. The reservoir portion 121 may be constituted of, for example, a rigid member. The reservoir portion 121 includes a reservoir chamber 120A having a constant volume. The reservoir portion 121 stores a liquid of an amount equal to or smaller than a first upper limit value V1. When the first upper limit value V1 is smaller than the volume of the reservoir chamber 120A, there is a region where the liquid is present and a region where a gas is present within the reservoir chamber 120A. The reservoir portion 121 may include a second atmospheric open valve 366 for opening the reservoir chamber 120A to the atmosphere.

The reservoir amount sensor 360 is able to detect the first upper limit value V1 and a second upper limit value V2 of the reservoir amount SA which is smaller than the first upper limit value V1. The reservoir amount sensor 360 may detect the lower limit value Vm. The reservoir amount sensor 360 may be a sensor for detecting a position of the liquid level in the reservoir chamber 120A. The control portion 60 may determine which of the first upper limit value V1, the second upper limit value V2, and the lower limit value Vm the reservoir amount SA has come to be, based on the position of the liquid level detected by the reservoir amount sensor 360. The reservoir amount sensor 360 may detect a situation in which the reservoir amount SA has come to be one of the first upper limit value V1, the second upper limit value V2, and the lower limit value Vm.

Operations of the present embodiment will be described.

The control portion 60 may drive the pressurization pump 363 in a state where an on-off valve 140 is opened when the liquid is supplied from the liquid supply source 101, or may drive the pressurization pump 363 in a state where the on-off valve 140 is closed in advance to maintain the air chamber 108 in a pressurized state. In the case where the air chamber 108 is maintained in the pressurized state, the liquid is supplied from the liquid supply source 101 to the reservoir portion 121 when the on-off valve 140 is opened. When the pressure in the air chamber 108 is lowered as a result of supplying the liquid, the control portion 60 drives the pressurization pump 363 based on the detection result of the pressure sensor 364.

The control portion 60 drives and controls the supply mechanism 361 so that the reservoir amount SA detected by the reservoir amount sensor 360 becomes equal to or smaller than the second upper limit value V2 when a remaining amount Ra is greater than a predetermined value VP. The control portion 60 detects the reservoir amount SA by the reservoir amount sensor 360, and opens the on-off valve 140 when the reservoir amount SA becomes equal to the lower limit value Vm. When the liquid is supplied from the liquid supply source 101 to the reservoir portion 121, the reservoir amount SA increases. The control portion 60 closes the on-off valve 140 to cause the reservoir amount SA to be equal to or smaller than the second upper limit value V2.

The control portion 60 drives and controls the supply mechanism 361 so that the reservoir amount SA becomes equal to or smaller than the first upper limit value V1 when the remaining amount Ra is equal to or smaller than the predetermined value VP. The control portion 60 opens the on-off valve 140 when the reservoir amount SA becomes equal to the lower limit value Vm. The control portion 60 closes the on-off valve 140 to cause the reservoir amount SA to be equal to or smaller than the first upper limit value V1.

The control portion 60 may return the liquid in the reservoir chamber 120A to the liquid supply source 101 when a stay of the liquid in the reservoir portion 121 exceeds a set time or when the power supply of the liquid ejecting apparatus 10 is to be turned off. Specifically, the control portion 60 opens the on-off valve 140 in a state in which the air chamber 108 is opened to the atmosphere. The liquid in the reservoir chamber 120A is moved to the liquid supply source 101 by the water head (energy possessed by the liquid) because the liquid level of the liquid stored in the reservoir portion 121 is positioned above the liquid position in the liquid supply source 101 attached to the liquid supply source holding portion 102. When the reservoir amount SA becomes equal to the lower limit value Vm, the control portion 60 closes the on-off valve 140. After the on-off valve 140 is closed or when the power supply of the liquid ejecting apparatus 10 is turned on, the control portion 60 may urge an operator to detach the liquid supply source 101 from the liquid supply source holding section 102 and shake the detached liquid supply source 101 so as to stir the liquid contained therein, or may drive an agitator mechanism (not illustrated) provided in the liquid supply source holding portion 102.

Effects of the third embodiment will be described below.

13. The reservoir amount sensor 360 detects the reservoir amount SA of the liquid stored in the reservoir portion 121. When the remaining amount Ra is greater than the predetermined value VP, the control portion 60 supplies the liquid to the reservoir portion 121 from the liquid supply source 101 so that the reservoir amount SA becomes equal to or smaller than the second upper limit value V2. When the remaining amount Ra is equal to or smaller than the predetermined value VP, the control portion 60 supplies the liquid to the reservoir portion 121 from the liquid supply source 101 so that the reservoir amount SA becomes equal to or smaller than the first upper limit value V1, which is greater than the second upper limit value V2. Accordingly, the above-discussed configuration can be suitably employed as a configuration in which the reservoir amount SA is reduced while the remaining amount Ra is greater than the predetermined value VP, and the remaining amount SA is increased when the remaining amount Ra becomes equal to or smaller than the predetermined value VP.

The present embodiment may be modified and implemented as follows. The present embodiment and the following modifications may be implemented in combination with each other within a range where no technical contradiction exists.

Figure 17:
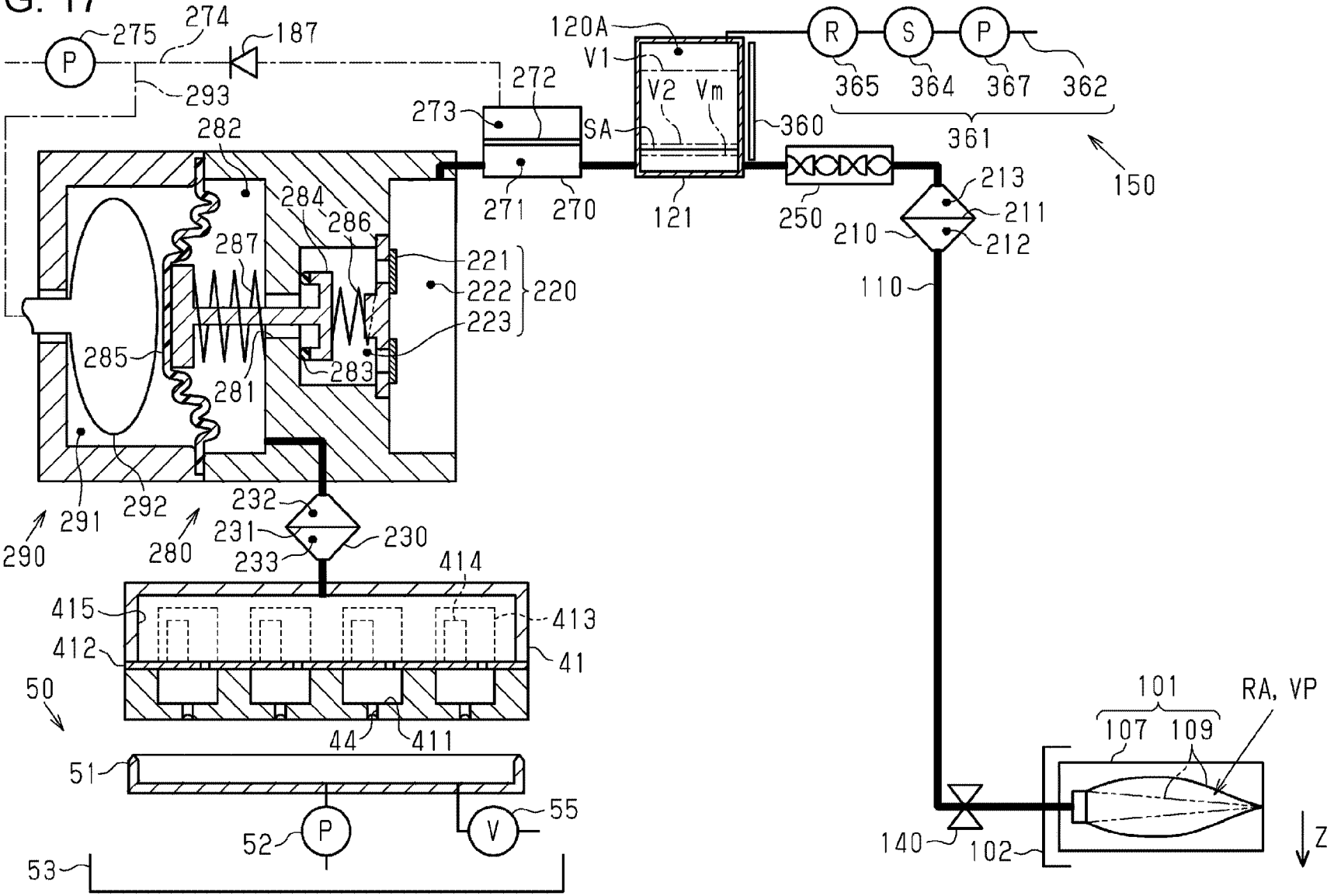
FIG. 17 is a schematic diagram illustrating a modification of a liquid ejecting apparatus.

As illustrated in FIG. 17, a supply mechanism 361 may depressurize the interior of a reservoir portion 121 to supply a liquid from a liquid supply source 101 to the reservoir portion 121. The supply mechanism 361 may include a coupling flow path 362 coupled to a reservoir chamber 120A, an exhaust pump 367 disposed in the coupling flow path 362, a pressure sensor 364, and an air pressure adjustment portion 365. The control portion 60 may drive the exhaust pump 367 in a state where an on-off valve 140 is opened, and may supply the liquid to the reservoir portion 121 from the liquid supply source 101.

When the flexible members 133 are bonded while pinching the connection body 123, a gap is generated between the flexible member 133 and the connection body 123 near the connection body 123. The gap is larger as the thickness of the connection body 123 is larger and the inner surfaces of the bag-like member 122 are farther separated from each other. Therefore, in a case in which the reservoir amount adjustment mechanism 150 applies pressure to the outside of the bag-like member 122, when the connection body 123 has such a thickness that a gap is formed between the connection body 123 and the flexible member 133, the coupling path 136 may not be provided.

The remaining amount acquisition portion 103 may be a terminal that is coupled to a storage portion included in the liquid supply source 101 and acquires information indicating the remaining amount Ra from the storage portion. The control portion 60 may determine whether the remaining amount Ra of the liquid contained in the liquid supply source 101 is equal to or smaller than the predetermined value VP or equal to or smaller than the limit value VL based on the information stored in the storage portion and the amount of the liquid consumed by the liquid ejecting apparatus 10.

The difference between the predetermined value VP and the limit value VL may be smaller than the difference between the first upper limit value V1 and the second upper limit value V2. The reservoir amount SA when the remaining amount Ra becomes equal to the predetermined value VP, may be smaller than the first upper limit value V1.

The second upper limit value V2 may be the reservoir amount SA in a state where the opposing inner surfaces of the bag-like member 122 are separated from each other. For example, the pressurization mechanism 170 may supply the liquid with such pressure that the inner surfaces of the bag-like member 122 are separated from each other.

The pressure mechanism 150 may include a spring configured to push the bag-like member 122 from the outside thereof. The pressure mechanism 150 may push the bag-like member 122 with the spring to make the reservoir amount SA equal to or smaller than the second upper limit value V2 when the remaining amount Ra is greater than the predetermined value VP, and may depressurize the interior of the pressure chamber 151 to make the reservoir amount SA equal to or smaller than first upper limit value V1 when the remaining amount Ra is equal to or smaller than the predetermined value VP.

The reservoir portion 121 may be constituted by, for example, a cylinder and a piston. The pressure mechanism 150 may adjust the reservoir amount SA by mechanically moving the piston.

The predetermined value VP may be smaller than the first upper limit value V1. When the remaining amount Ra becomes equal to the predetermined value VP, the control portion 60 may supply the liquid contained in the liquid supply source 101 to the reservoir portion 121 and may urges the replacement of the liquid supply source 101. At this time, the reservoir amount SA may be smaller than the first upper limit value V1.

The bag-like member 122 may be formed by a sheet of flexible member 133.

Technical ideas and operational advantages understood from the above embodiments and modifications will be described below.

A liquid ejecting apparatus includes a liquid ejecting portion configured to eject a liquid through a nozzle; a liquid supply source holding portion configured to attach and detach a liquid supply source for containing the liquid; a liquid supply flow path configured to supply the liquid from the liquid supply source attached to the liquid supply source holding portion to the liquid ejecting portion; a reservoir portion provided in the liquid supply flow path and configured to store the liquid; a reservoir amount adjustment mechanism configured to adjust a reservoir amount of the liquid stored in the reservoir portion; and a control portion configured to control the reservoir amount adjustment mechanism in such a manner that, when an upper limit value of the reservoir amount is defined as a first upper limit value in a case in which a remaining amount of the liquid contained in the liquid supply source is equal to or smaller than a predetermined value, the reservoir amount when the remaining amount is larger than the predetermined value is caused to be smaller than the first upper limit value.

For example, when a liquid of the first upper limit value is stored in the reservoir portion regardless of the remaining amount, the time for which the liquid stays in the reservoir portion becomes long so that the settling components are likely to settle. In this regard, according to this configuration, when the remaining amount of the liquid contained in the liquid supply source is larger than the predetermined value, the control portion causes the reservoir amount to be smaller than the first upper limit value. As a result, while the remaining amount is larger than the predetermined value, the reservoir amount becomes small so that the time for which the liquid stays in the reservoir portion can be shortened. Accordingly, it is possible to reduce the risk of the progress of the settling of the settling components, and reduce the risk that the liquid in which the settling of the settling components has progressed is supplied to the liquid ejecting portion.

In the liquid ejecting apparatus, the predetermined value may be equal to or larger than the first upper limit value, and the control portion may control the reservoir amount adjustment mechanism in such a manner that the reservoir amount becomes equal to the first upper limit value when the remaining amount becomes equal to the predetermined value.

According to this configuration, when the remaining amount becomes equal to the predetermined value, the control portion controls the reservoir amount adjustment mechanism to cause the reservoir amount to be equal to the first upper limit value. Accordingly, even when the liquid is unable to be supplied from the liquid supply source to the reservoir portion like in a case where the liquid supply source is detached from the holding portion to be replaced, for example, the liquid stored in the reservoir portion can be supplied to the liquid ejecting portion.

In the liquid ejecting apparatus, the reservoir portion may include a bag-like member formed of a flexible member having flexibility, and a connection body coupled to the liquid supply flow path, and the reservoir amount adjustment mechanism may change a volume of the interior of the bag-like member by applying pressure to the outside of the bag-like member so as to adjust the reservoir amount.

According to this configuration, the reservoir portion includes the bag-like member formed of the flexible member. The bag-like member having flexibility is deformed by the pressure applied to the outside of the bag-like member, so that the volume of the interior of the bag-like member is changed. Accordingly, the configuration in which the reservoir amount adjustment mechanism applies the pressure to the outside of the bag-like member may be suitably employed as a configuration for adjusting the reservoir amount.

In the liquid ejecting apparatus, the control portion may control the reservoir amount adjustment mechanism in such a manner that, when the remaining amount is equal to or smaller than the predetermined value, a lower pressure may be applied to the outside of the bag-like member than the pressure applied when the remaining amount is larger than the predetermined value.

The volume of the interior of the bag-like member becomes larger as the pressure applied to the outside of the bag-like member is lower. In this respect, according to this configuration, when the remaining amount is equal to or smaller than the predetermined value, a lower pressure is applied to the outside of the bag-like member than the pressure applied when the remaining amount is larger than the predetermined value, thereby making it possible to increase the volume of the interior of the bag-like member. Therefore, it is possible to suitably employ the above mechanism as a mechanism for changing the volume of the interior of the bag-like member.

In the liquid ejecting apparatus, when the remaining amount is larger than the predetermined value, the opposing inner surfaces of the bag-like member may be in contact with each other in the reservoir portion.

According to this configuration, when the remaining amount is larger than the predetermined value, the opposing inner surfaces among the inner surfaces included in the bag-like member make contact with each other. With this, the volume of the interior of the bag-like member becomes small, so that the reservoir amount of the liquid stored in the bag-like member becomes significantly small. This makes it possible to shorten the time for which the liquid stays in the reservoir portion, and reduce the risk that the liquid in which the settling of the settling components has progressed is supplied to the liquid ejecting portion.

In the liquid ejecting apparatus, the reservoir amount adjustment mechanism may include a reservoir amount sensor configured to detect the first upper limit value and a second upper limit value of the reservoir amount smaller than the first upper limit value, and a supply mechanism for supplying the liquid contained in the liquid supply source to the reservoir portion. The control portion may drive and control the supply mechanism to cause the reservoir amount detected by the reservoir amount sensor to be equal to or smaller than the second upper limit value when the remaining amount is larger than the predetermined value, and may drive and control the supply mechanism to cause the reservoir amount to be equal to or smaller than the first upper limit value when the remaining amount is equal to or smaller than the predetermined value.

According to this configuration, the reservoir amount sensor detects the reservoir amount of the liquid stored in the reservoir portion. When the remaining amount is larger than the predetermined value, the control portion supplies the liquid to the reservoir portion from the liquid supply source so that the reservoir amount becomes equal to or smaller than the second upper limit value. When the remaining amount is equal to or smaller than the predetermined value, the control portion supplies the liquid to the reservoir portion from the liquid supply source so that the reservoir amount becomes equal to or smaller than the first upper limit value, which is larger than the second upper limit value. Accordingly, the above-discussed configuration can be suitably employed as a configuration in which the reservoir amount is reduced while the remaining amount is larger than the predetermined value, and the remaining amount is increased when the remaining amount becomes equal to or smaller than the predetermined value.

A control method for a liquid ejecting apparatus is a control method for the liquid ejecting apparatus that includes a liquid ejecting portion configured to eject a liquid through a nozzle; a liquid supply flow path configured to supply the liquid contained in a liquid supply source to the liquid ejecting portion; and a reservoir portion provided in the liquid supply flow path and configured to store the liquid. The method includes, when an upper limit value of a reservoir amount of the liquid stored in the reservoir portion is defined as a first upper limit value in a case in which a remaining amount of the liquid contained in the liquid supply source is equal to or smaller than a predetermined value, performing adjustment in such a manner that the reservoir amount when the remaining amount is larger than the predetermined value is caused to be smaller than the first upper limit value. According to this method, the same effects as those in the liquid ejecting apparatus may be achieved.

In the control method for the liquid ejecting apparatus, the predetermined value may be equal to or larger than the first upper limit value, and the reservoir amount may be so adjusted as to be equal to the first upper limit value when the remaining amount becomes equal to the predetermined value. According to this method, the same effects as those in the liquid ejecting apparatus may be achieved.

What is claimed is:

1. A liquid ejecting apparatus comprising:

a liquid ejecting portion configured to eject a liquid through a nozzle;

a liquid supply flow path configured to supply the liquid contained in a liquid supply source to the liquid ejecting portion;

a liquid reservoir unit including a reservoir portion that is provided in the liquid supply flow path and is configured to store the liquid;

a discharge mechanism configured to discharge the liquid in the liquid supply flow path from the liquid ejecting portion side relative to the reservoir portion in the liquid supply flow path by depressurizing the liquid supply flow path; and a control portion configured to control the discharge mechanism to discharge the liquid staying in the reservoir portion as a waste liquid when a stay of the liquid in the reservoir portion exceeds a set time.

2. The liquid ejecting apparatus according to claim 1, wherein the liquid reservoir unit includes a bag-like member constituting the reservoir portion, an outflow portion disposed at a position near a first end of the reservoir portion and configured to cause the liquid to flow out of the reservoir portion, and an inflow portion disposed at a position near the first end and configured to cause the liquid to flow into the reservoir portion, the outflow portion is coupled to part of the liquid supply flow path closer to the liquid ejecting portion, and the inflow portion is coupled to part of the liquid supply flow path closer to the liquid supply source.

3. The liquid ejecting apparatus according to claim 2, further comprising:

a holding portion for holding the liquid reservoir unit, wherein the outflow portion has an outflow opening opened to an interior of the reservoir portion, the inflow portion has an inflow opening opened to the interior of the reservoir portion, the outflow opening and the inflow opening are located at different positions in a width direction which is a lengthwise direction of the reservoir portion when the reservoir portion is viewed from the first end, and the holding portion holds the reservoir portion in such a manner that a height direction which is a short-length direction of the reservoir portion when the reservoir portion is viewed from the first end, is taken as a vertical direction.

4. The liquid ejecting apparatus according to claim 3, wherein the outflow opening and the inflow opening are located at different positions in a depth direction from the first end toward a second end on the opposite side to the first end.

5. The liquid ejecting apparatus according to claim 3, wherein the inflow opening is opened facing a second end on the opposite side to the first end.

6. The liquid ejecting apparatus according to claim 3, wherein the outflow opening is opened to a position closer to the first end than to a second end on the opposite side to the first end, and the inflow opening is opened to a position closer to the second end than to the first end.

7. The liquid ejecting apparatus according to claim 1, wherein the reservoir portion is constituted of a bag-like member having flexibility.

8. The liquid ejecting apparatus according to claim 1, wherein:

the liquid reservoir unit further includes:

an outflow portion disposed at a position near a first end of the reservoir portion and configured to cause the liquid to flow out of the reservoir portion; and an inflow portion disposed at a position near the first end of the reservoir portion and configured to cause the liquid to flow into the reservoir portion, the outflow portion includes an outflow opening opened to an interior of the reservoir portion, the inflow portion includes an inflow opening opened to the interior of the reservoir portion, and the outflow opening and the inflow opening are located at different positions in a width direction which is a lengthwise direction of the reservoir portion when the reservoir portion is viewed from the first end, and also located at different positions in a depth direction from the first end toward a second end on an opposite side to the first end.

9. The liquid ejecting apparatus according to claim 8, wherein the inflow opening is opened facing the second end.

10. The liquid ejecting apparatus according to claim 8, wherein the outflow opening is opened to a position closer to the first end than to the second end, and the inflow opening is opened to a position closer to the second end than to the first end.

11. The liquid ejecting apparatus according to claim 8, wherein the reservoir portion is constituted of a bag-like member having flexibility.

12. The liquid ejecting apparatus according to claim 8, wherein:

the reservoir portion has a first vertical side and a second vertical side, and the first vertical side and the second vertical side being at opposite ends of the reservoir, and the outflow opening and the inflow opening open to different positions in the depth direction from the first vertical side toward the second vertical side.

13. The liquid ejecting apparatus according to claim 8, wherein:

when the liquid reservoir unit is in use, the liquid reservoir unit is in a posture where the inflow opening and the outflow opening are horizontally aligned.

14. A liquid ejecting apparatus comprising:

a liquid ejecting portion configured to eject a liquid through a nozzle;

a liquid supply source holding portion configured to attach and detach a liquid supply source for containing the liquid;

a liquid supply flow path configured to supply the liquid from the liquid supply source attached to the liquid supply source holding portion to the liquid ejecting portion;

a reservoir portion provided in the liquid supply flow path and configured to store the liquid;

a reservoir amount adjustment mechanism configured to adjust a reservoir amount of the liquid stored in the reservoir portion; and a control portion configured to control the reservoir amount adjustment mechanism in such a manner that, when an upper limit value of the reservoir amount is defined as a first upper limit value in a case in which a remaining amount of the liquid contained in the liquid supply source is equal to or smaller than a predetermined value, the reservoir amount when the remaining amount is larger than the predetermined value is caused to be smaller than the first upper limit value.

15. The liquid ejecting apparatus according to claim 14, wherein the predetermined value is equal to or larger than the first upper limit value, and the control portion controls the reservoir amount adjustment mechanism to cause the reservoir amount becomes equal to the first upper limit value when the remaining amount becomes equal to the predetermined value.

16. The liquid ejecting apparatus according to claim 14, wherein the reservoir amount adjustment mechanism includes a reservoir amount sensor configured to detect the first upper limit value and a second upper limit value of the reservoir amount smaller than the first upper limit value, and a supply mechanism for supplying the liquid contained in the liquid supply source to the reservoir portion, and the control portion drives and controls the supply mechanism to cause the reservoir amount detected by the reservoir amount sensor to be equal to or smaller than the second upper limit value when the remaining amount is larger than the predetermined value, and drives and controls the supply mechanism to cause the reservoir amount to be equal to or smaller than the first upper limit value when the remaining amount is equal to or smaller than the predetermined value.

17. The liquid ejecting apparatus according to claim 14, wherein the reservoir portion includes a bag-like member formed of a flexible member having flexibility, and a connection body coupled to the liquid supply flow path, and the reservoir amount adjustment mechanism changes a volume of an interior of the bag-like member by applying pressure to an outside of the bag-like member so as to adjust the reservoir amount.

18. The liquid ejecting apparatus according to claim 17, wherein the control portion controls the reservoir amount adjustment mechanism in such a manner that, when the remaining amount is equal to or smaller than the predetermined value, a lower pressure is applied to the outside of the bag-like member than the pressure applied when the remaining amount is larger than the predetermined value.

19. The liquid ejecting apparatus according to claim 17, wherein when the remaining amount is larger than the predetermined value, opposing inner surfaces of the bag-like member are in contact with each other in the reservoir portion.

20. A maintenance method for a liquid ejecting apparatus that includes a liquid ejecting portion configured to eject a liquid through a nozzle, a liquid supply flow path configured to supply the liquid contained in a liquid supply source to the liquid ejecting portion, and a liquid reservoir unit having a reservoir portion that is provided in the liquid supply flow path and is configured to store the liquid, the method comprising:

discharging the liquid staying in the reservoir portion as a waste liquid when a stay of the liquid in the reservoir portion exceeds a set time.

* * * * *